US011090958B2

(12) United States Patent
Arakane

(10) Patent No.: US 11,090,958 B2
(45) Date of Patent: Aug. 17, 2021

(54) CONTROL DEVICE, COMPUTER-READABLE MEDIUM, AND METHOD FOR EVACUATING PRINT HEAD AS NEEDED

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/817,967

(22) Filed: Mar. 13, 2020

(65) Prior Publication Data

US 2020/0307281 A1 Oct. 1, 2020

(30) Foreign Application Priority Data

Mar. 28, 2019 (JP) ..... JP2019-062229

(51) Int. Cl.

| | |
|---|---|
| ***B41J 13/00*** | (2006.01) |
| ***B41J 19/20*** | (2006.01) |
| ***B41J 29/38*** | (2006.01) |
| ***B41J 11/00*** | (2006.01) |
| ***B41J 25/00*** | (2006.01) |
| ***B41J 13/14*** | (2006.01) |
| ***B41J 13/02*** | (2006.01) |
| ***B41J 2/17*** | (2006.01) |

(52) U.S. Cl.

CPC ..... *B41J 19/202* (2013.01); *B41J 2/1707* (2013.01); *B41J 11/007* (2013.01); *B41J 11/0095* (2013.01); *B41J 13/0027* (2013.01); *B41J 13/02* (2013.01); *B41J 13/14* (2013.01); *B41J 25/005* (2013.01); *B41J 29/38* (2013.01); *B41J 2202/15* (2013.01)

(58) Field of Classification Search

CPC .... B41J 19/202; B41J 13/0027; B41J 11/007; B41J 29/38; B41J 25/005; B41J 13/14; B41J 11/0095; B41J 13/02; B41J 2/1707; B41J 2202/15

See application file for complete search history.

(56) References Cited

U.S. PATENT DOCUMENTS

| | | | | |
|---|---|---|---|---|
| 2006/0145414 | A1* | 7/2006 | Yokobori | G03G 15/70 271/258.01 |
| 2015/0062228 | A1* | 3/2015 | Ogimura | B41J 13/02 347/16 |
| 2017/0269529 | A1* | 9/2017 | Nakamichi | G03G 15/55 |

FOREIGN PATENT DOCUMENTS

| | | | |
|---|---|---|---|
| JP | 2000-071540 | A | 3/2000 |

* cited by examiner

*Primary Examiner* — Yaovi M Ameh
(74) *Attorney, Agent, or Firm* — Burr & Brown, PLLC

(57) ABSTRACT

A control device includes a processor and a memory storing computer-readable instructions that, when executed, cause the processor to control a print execution device to perform printing on a first sheet and a second sheet, when at least one specific condition is not satisfied with respect to the first sheet being printed, after final partial printing on the first sheet, start final conveyance of the first sheet in a state where a plurality of nozzles are located within a sheet range in which the first sheet is placed in a main scanning direction, and when the at least one specific condition is satisfied, after the final partial printing on the first sheet, move a print head to such a position that the plurality of nozzles are located outside the sheet range in the main scanning direction, before starting the final conveyance of the first sheet.

10 Claims, 20 Drawing Sheets

CONTROL DEVICE, COMPUTER-READABLE MEDIUM, AND METHOD FOR EVACUATING PRINT HEAD AS NEEDED

CROSS-REFERENCE TO RELATED APPLICATION

This application claims priority under 35 U.S.C. § 119 from Japanese Patent Application No. 2019-062229 filed on Mar. 28, 2019. The entire subject matter of the application is incorporated herein by reference.

BACKGROUND

Technical Field

Aspects of the present disclosure are related to a control device, a non-transitory computer-readable medium, and a method for evacuating a print head of a printer as needed.

Related Art

A serial printer has been known that is configured to perform printing on a sheet by moving a print head along a main scanning direction relative to the sheet and conveying the sheet in a sub scanning direction. The serial printer is further configured to determine a main scanning pattern for printing each printing block, based on a positional relationship in the main scanning direction between a preceding printing block to be printed in next main scanning and a succeeding printing block to be printed in main scanning after the next main scanning. Thereby, it is possible to shorten a period of time for printing.

SUMMARY

However, the aforementioned known technology does not take into sufficient consideration sequential printing operations on a plurality of sheets. Therefore, the known serial printer might be unable to suppress a reduction in a printing speed for a plurality of sheets.

Aspects of the present disclosure are advantageous to provide one or more improved techniques for evacuating a print head of a printer as needed that make it possible to, when a plurality of sheets are printed, prevent a sheet being printed from contacting nozzles of the print head and suppress a reduction in a printing speed.

According to aspects of the present disclosure, a control device is provided, which includes a processor configured to control a print execution device, and a memory storing computer-readable instructions. The print execution device includes a print head having a plurality of nozzles configured to discharge ink onto a sheet, a main scanning mechanism configured to perform a main scanning operation to move the print head along a main scanning direction relative to the sheet, and a conveyor configured to convey the sheet in a conveyance direction intersecting the main scanning direction relative to the print head. The print execution device is configured to perform printing by repeatedly performing a partial printing operation to cause the print head to form dots on the sheet during the main scanning operation and a conveyance operation to cause the conveyor to convey the sheet in the conveyance direction. The computer-readable instructions stored in the memory are configured to, when executed by the processor, cause the processor to obtain image data, control, based on the obtained image data, the print execution device to perform printing on a plurality of sheets including a first sheet and a second sheet, the printing including a final partial printing operation on the first sheet, a final conveyance operation to convey the first sheet after the final partial printing operation on the first sheet, an initial conveyance operation to convey the second sheet to be printed after the first sheet, and an initial partial printing operation on the second sheet after the initial conveyance operation to convey the second sheet, determine whether one or more specific conditions are satisfied with respect to the first sheet being printed, the one or more specific conditions representing that when the one or more specific conditions are satisfied, the first sheet is more likely to be deformed than when at least one of the one or more specific conditions is not satisfied, in a first case where at least one of the one or more specific conditions is not satisfied, after the final partial printing operation on the first sheet, control the print execution device to start the final conveyance operation to convey the first sheet in a state where the plurality of nozzles are located within a sheet range in which the first sheet is placed in the main scanning direction, within a movable range in which the print head is movable in the main scanning direction, and in a second case where the one or more specific conditions are satisfied, after the final partial printing operation on the first sheet, control the print execution device to move the print head to such a position that the plurality of nozzles are located out of the sheet range in the main scanning direction, within the movable range in the main scanning direction, before starting the final conveyance operation to convey the first sheet.

According to aspects of the present disclosure, further provided is a non-transitory computer-readable medium storing computer-readable instructions executable by a processor configured to control a print execution device. The print execution device includes a print head having a plurality of nozzles configured to discharge ink onto a sheet, a main scanning mechanism configured to perform a main scanning operation to move the print head along a main scanning direction relative to the sheet, and a conveyor configured to convey the sheet in a conveyance direction intersecting the main scanning direction relative to the print head. The print execution device is configured to perform printing by repeatedly performing a partial printing operation to cause the print head to form dots on the sheet during the main scanning operation and a conveyance operation to cause the conveyor to convey the sheet in the conveyance direction. The computer-readable instructions are configured to, when executed by the processor, cause the processor to obtain image data, control, based on the obtained image data, the print execution device to perform printing on a plurality of sheets including a first sheet and a second sheet, the printing including a final partial printing operation on the first sheet, a final conveyance operation to convey the first sheet after the final partial printing operation on the first sheet, an initial conveyance operation to convey the second sheet to be printed after the first sheet, and an initial partial printing operation on the second sheet after the initial conveyance operation to convey the second sheet, determine whether one or more specific conditions are satisfied with respect to the first sheet being printed, the one or more specific conditions representing that when the one or more specific conditions are satisfied, the first sheet is more likely to be deformed than when at least one of the one or more specific conditions is not satisfied, in a first case where at least one of the one or more specific conditions is not satisfied, after the final partial printing operation on the first sheet, control the print execution device to start the final conveyance operation to convey the first sheet in a state where the plurality of nozzles are located within a sheet range in which the first sheet is placed in the main scanning direction, within a movable range in which the print head is movable in the main scanning direction, and in a second case where the one or more specific conditions are satisfied, after the final partial printing operation on the first sheet, control the print execution device to move the print head to such a position that the plurality of nozzles are located out of the sheet range in the main scanning direction, within the movable range in the main scanning direction, before starting the final conveyance operation to convey the first sheet.

According to aspects of the present disclosure, further provided is a method implementable on a processor configured to control a print execution device. The print execution device includes a print head having a plurality of nozzles configured to discharge ink onto a sheet, a main scanning mechanism configured to perform a main scanning operation to move the print head along a main scanning direction relative to the sheet, and a conveyor configured to convey the sheet in a conveyance direction intersecting the main scanning direction relative to the print head. The print execution device is configured to perform printing by repeatedly performing a partial printing operation to cause the print head to form dots on the sheet during the main scanning operation and a conveyance operation to cause the conveyor to convey the sheet in the conveyance direction. The method includes obtaining image data, controlling, based on the obtained image data, the print execution device to perform printing on a plurality of sheets including a first sheet and a second sheet, the printing including a final partial printing operation on the first sheet, a final conveyance operation to convey the first sheet after the final partial printing operation on the first sheet, an initial conveyance operation to convey the second sheet to be printed after the first sheet, and an initial partial printing operation on the second sheet after the initial conveyance operation to convey the second sheet, determining whether one or more specific conditions are satisfied with respect to the first sheet being printed, the one or more specific conditions representing that when the one or more specific conditions are satisfied, the first sheet is more likely to be deformed than when at least one of the one or more specific conditions is not satisfied, in a first case where at least one of the one or more specific conditions is not satisfied, after the final partial printing operation on the first sheet, controlling the print execution device to start the final conveyance operation to convey the first sheet in a state where the plurality of nozzles are located within a sheet range in which the first sheet is placed in the main scanning direction, within a movable range in which the print head is movable in the main scanning direction, and in a second case where the one or more specific conditions are satisfied, after the final partial printing operation on the first sheet, controlling the print execution device to move the print head to such a position that the plurality of nozzles are located out of the sheet range in the main scanning direction, within the movable range in the main scanning direction, before starting the final conveyance operation to convey the first sheet.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

A. Illustrative Embodiment

Hereinafter, an illustrative embodiment according to aspects of the present disclosure will be described with reference to the accompanying drawings.

A-1. Configuration of Printer

Figure 1:
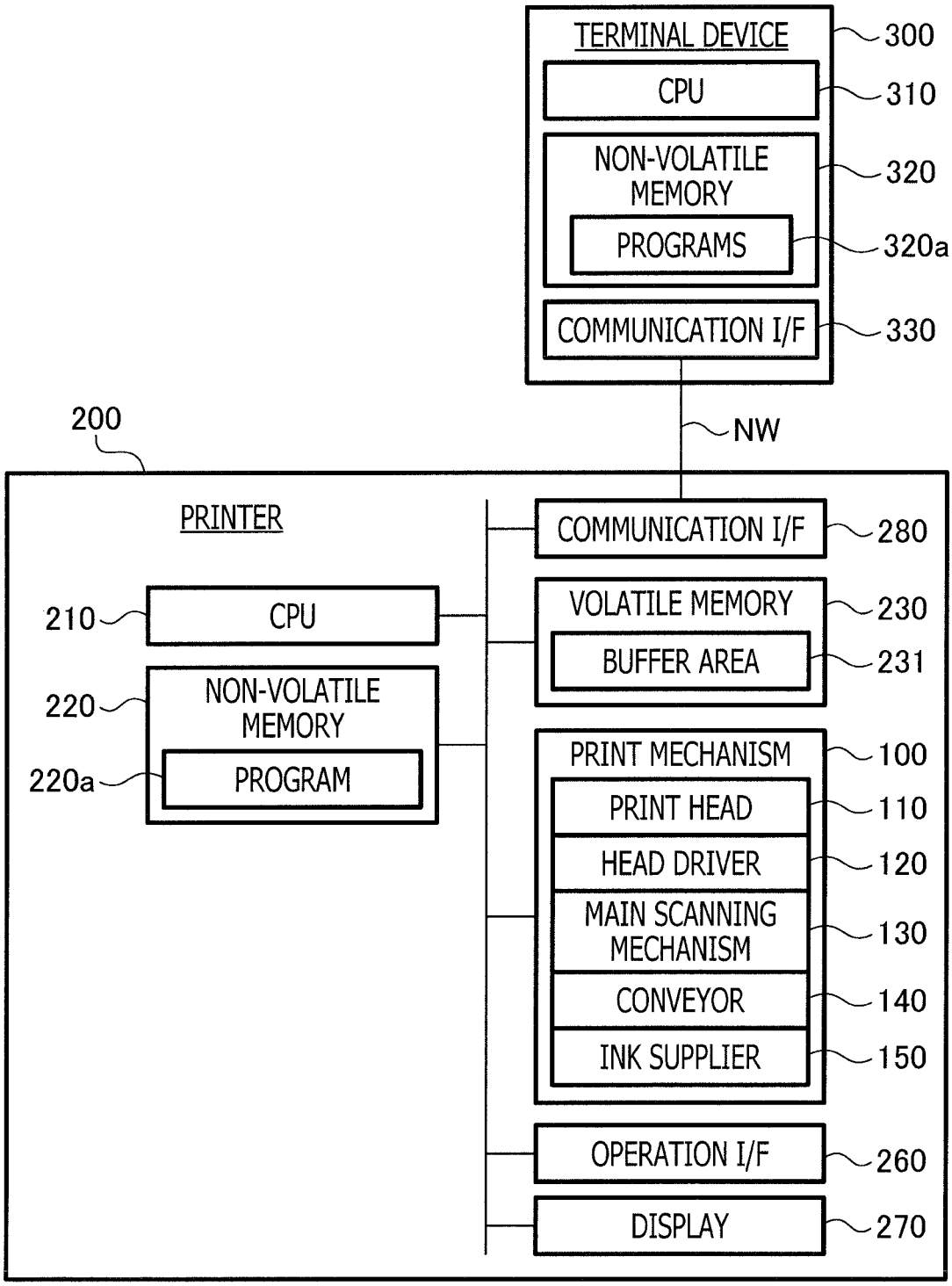
FIG. 1 is a block diagram schematically showing a configuration of a printer in an illustrative embodiment according to one or more aspects of the present disclosure.

FIG. 1 is a block diagram showing a configuration of a printer 200 in the illustrative embodiment. For instance, the printer 200 includes a CPU 210 as a controller for the printer 200, a non-volatile memory 220 (e.g., a hard disk drive), a volatile memory 230 (e.g., a RAM), an operation I/F ("I/F" is an abbreviation of "interface") 260, a display 270, and a communication I/F 280. The operation I/F 260 may include buttons and a touch panel for receiving user operations. The communication I/F 280 may include a wired communication I/F and/or a wireless communication I/F for connecting with a network NW. The printer 200 is communicably connected with external devices such as a terminal device 300 via the communication I/F 280. It is noted that, as shown in FIG. 1, the terminal device 300 includes a CPU 310, a non-volatile memory 320 storing computer programs 320*a*, and a communication I/F 330 for connecting with the network NW.

The volatile memory 230 provides a buffer area 231 for temporarily storing various types of intermediate data to be generated when the CPU 210 performs processes. The non-volatile memory 220 stores a computer program 220*a*. In the illustrative embodiment, the computer program 220*a* is a control program for controlling the printer 200. For instance, the computer program 220*a* may be stored into the non-volatile memory 220 when the printer 200 is shipped. In another instance, the computer program 220*a* may be downloaded from a server. In yet another instance, a DVD-ROM with the computer program 220*a* stored may be provided to a user of the printer 200. For instance, the CPU 210 performs a below-mentioned printing process (see FIG. 8) by executing the computer program 220*a*. Thereby, the CPU 210 controls a print mechanism 100 to form an image on a print medium (e.g., a sheet).

The print mechanism 100 is configured to perform color printing by forming dots on a sheet M with ink of four colors, i.e., cyan (C), magenta (M), yellow (Y), and black (K). The print mechanism 100 includes a print head 110, a head driver 120, a main scanning mechanism 130, a conveyor 140, and an ink supplier 150.

Figure 2:
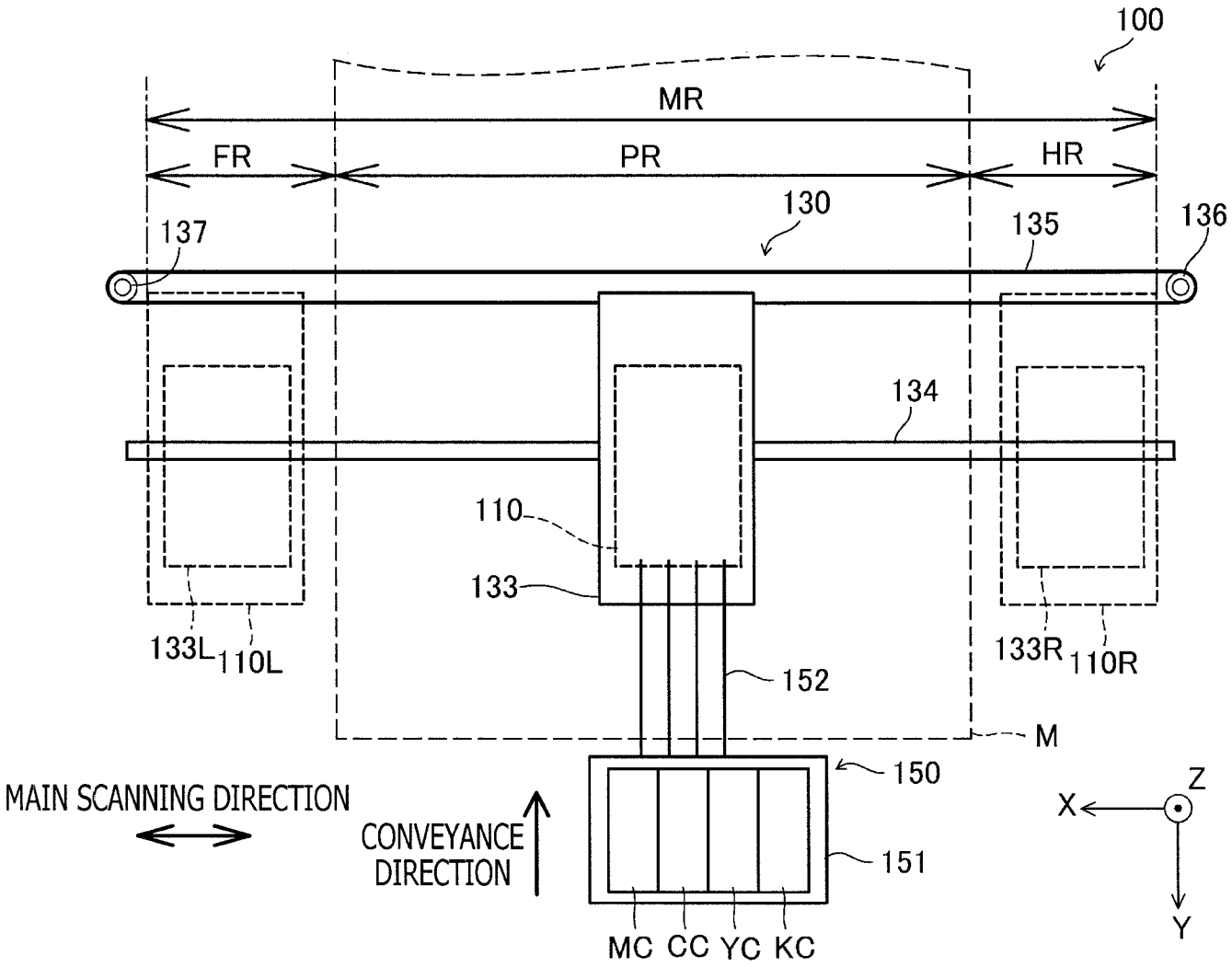
FIG. 2 is a plan view, from a downstream side in a Z-axis direction, schematically showing a configuration of a print mechanism of the printer in the illustrative embodiment according to one or more aspects of the present disclosure.

FIG. 2 schematically shows a configuration of the print mechanism 100. As shown in FIG. 2, the main scanning mechanism 130 includes a carriage 133, a sliding shaft 134, and a belt 135, pulleys 136 and 137. The carriage 133 has the print head 110 mounted thereon. The sliding shaft 134 is configured to support the carriage 133 in such a manner that the carriage 133 is enabled to reciprocate along a main scanning direction (i.e., an X-axis direction in FIG. 2). The belt 135 is wound around the pulleys 136 and 137. Further, a part of the belt 135 is fixedly attached to the carriage 133. The pulley 136 is configured to rotate by a driving force from a main scanning motor (not shown). When the pulley 136 is rotated by the driving force from the main scanning motor, the carriage moves along the sliding shaft 134. Thus, the print mechanism 100 performs main scanning to reciprocate the print head 100 along the main scanning direction relative to the sheet M.

FIG. 2 shows a movable range MR in which the print head 110 is movable in the main scanning direction. The movable range MR includes a sheet range PR, a home-side range HR, and a flushing-side range FR. The sheet range PR is a range in which the sheet M to be conveyed by the conveyor is positioned. The home-side range HR and the flushing-side range FR are outside the sheet range PR in the main scanning direction.

The home-side range HR is positioned upstream of the sheet range PR in the X-axis direction. The home-side range HR contains a home position of the print head 110. The home position is a position where the print head 110 stays, for instance, while the CPU 210 is waiting for a print instruction from the terminal device 300. When the print head 110 is in the home position, a nozzle-formed surface 111 of the print head 110 is covered with a nozzle cap (not shown).

The flushing-side range FR is positioned downstream of the sheet range PR in the X-axis direction. The flushing-side range FR is a range in which an ink receiver 170 (see FIGS. 6A and 6B) is disposed. The ink receiver 170 is configured to receive ink discharged from the print head 110 in below-mentioned flushing.

In FIG. 2, the carriage 133 and the print head 110 which have reached a downstream end of the movable range MR in the X-axis direction are shown by dashed lines identified with reference characters 133L and 110L, respectively. Further, the carriage 133 and the print head 110 which have reached an upstream end of the movable range MR in the X-axis direction are shown by dashed lines identified with reference characters 133R and 110R, respectively. Thus, the carriage 133 is movable to such a position that the print head 100 is entirely positioned downstream of the sheet range PR in the X-axis direction. Further, the carriage 133 is movable to such a position that the print head 100 is entirely positioned upstream of the sheet range PR in the X-axis direction.

The ink supplier 150 is configured to supply ink to the print head 110. The ink supplier includes a cartridge attachment section 151 and tubes 152. The cartridge attachment section 151 is configured such that a plurality of ink cartridges MC, CC, YC, and KC are detachably attached thereto. Each of the ink cartridges MC, CC, YC, and KC is a container in which ink of a corresponding color is stored. The print head 110 is supplied with ink from the ink cartridges MC, CC, YC, and KC via the cartridge attachment section 151 and the tubes 152.

Figure 3:
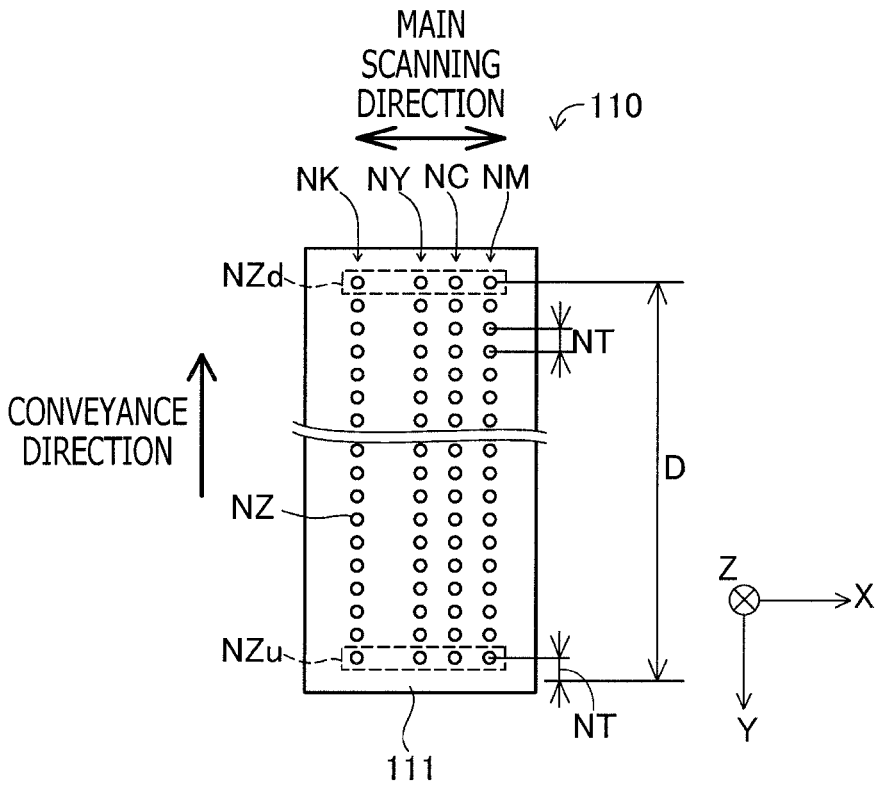
FIG. 3 is a plan view, from an upstream side in the Z-axis direction, schematically showing a configuration of a print head of the print mechanism in the illustrative embodiment according to one or more aspects of the present disclosure.

FIG. 3 is a plan view showing a configuration of the print head 110 when viewed from an upstream side of the print head 110 in the Z-axis direction. As shown in FIG. 3, the nozzle-formed surface 111 of the print head 110 is disposed to face the sheet M being conveyed by the conveyor 140, in the Z-axis direction. The nozzle-formed surface 111 has a plurality of nozzle rows NK, NY, NC, and NM formed therein. Each of the nozzle rows includes a plurality of nozzles NZ configured to discharge therefrom ink of a corresponding one of the colors C, M, Y, and K. The plurality of nozzles NZ included in each nozzle row are disposed in respective different positions in the Y-axis direction, and are arranged at intervals of a particular distance NT along the conveyance direction. The particular distance NT is a length in the conveyance direction between mutually-adjacent two of the plurality of nozzles NZ included in each nozzle row. Hereinafter, a most upstream one of the plurality of nozzles NZ included in each nozzle row in the conveyance direction may be referred to as a "most upstream nozzle NZu." Further, a most downstream one of the plurality of nozzles NZ included in each nozzle row in the conveyance direction may be referred to as a "most downstream nozzle NZd." A sum of a length from the most upstream nozzle NZu to the most downstream nozzle NZd in the conveyance direction and the particular distance NT may be referred to as a "nozzle length D."

The plurality of nozzle rows NK, NY, NC, and NM are disposed in respective different positions in the X-axis direction, and are positioned to overlap with each other in the Y-axis direction (i.e., to overlap with each other when viewed along the X-axis direction). In an example shown in FIG. 3, the plurality of nozzle rows NK, NY, NC, and NM are arranged in the same order as cited, from a most upstream one to a most downstream one of the nozzle rows in the X-axis direction.

Each nozzle NZ is connected with a corresponding one of ink flow passages (not shown) formed inside the print head 110. The print head 110 includes actuators (not shown, e.g., piezoelectric actuators) each configured to discharge ink along a corresponding one of the ink flow passages inside the print head 110.

The head driver 120 (see FIG. 1) is controlled by the CPU 210 to drive each actuator inside the print head 110 in accordance with print data while the main scanning mechanism 130 is performing main scanning. Thus, ink droplets discharged from the nozzles NZ of the print head 110 land on the sheet M being conveyed by the conveyor 140, thereby forming dots on the sheet M. The head driver 120 is configured to form dots having a plurality of different sizes on the sheet M by changing a driving voltage supplied to each actuator.

Figure 4A:
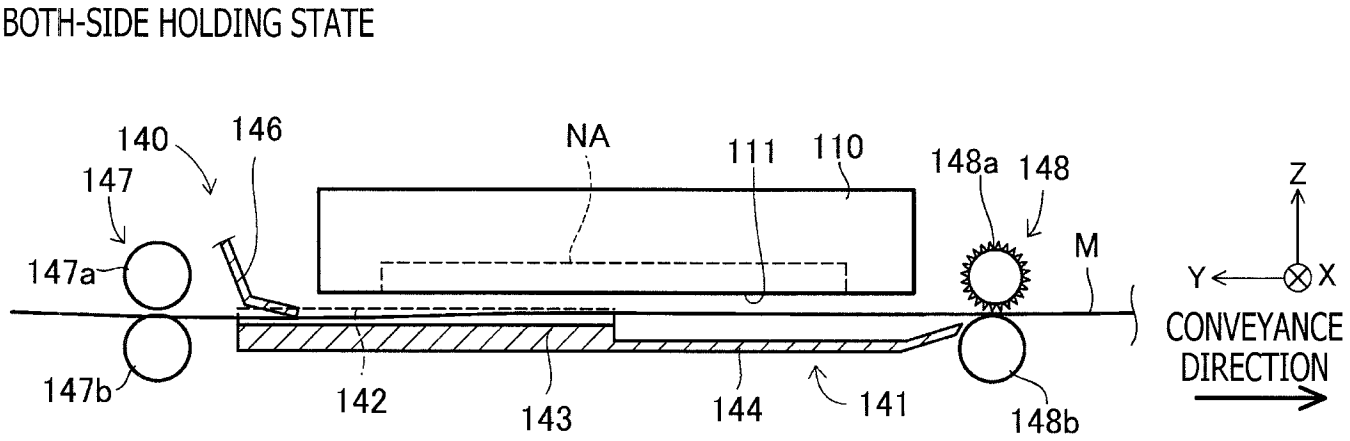
FIG. 4A is a side view, from an upstream side in an X-axis direction, schematically showing a both-side holding state where both sides of a sheet in a conveyance direction are held by a conveyor, in the illustrative embodiment according to one or more aspects of the present disclosure.

The conveyor 140 is configured to, while holding the sheet M, convey the sheet M in the conveyance direction which is opposite to the Y-axis direction as shown in FIG. 2. FIGS. 4A, 4B, 5A, and 5B schematically show a configuration of the conveyor 140. As shown in FIG. 4A, the conveyor 140 includes a sheet table 141, two upstream rollers 147, two downstream rollers 148, and a plurality of pressing members 146. In FIG. 4A, a nozzle area NA is an area in which the nozzle rows NK, NY, NC, and NM are formed.

The upstream rollers 147 are disposed upstream of the print head 110 in the conveyance direction. The downstream rollers 148 are disposed downstream of the print head 110 in the conveyance direction. The upstream rollers 147 include a driving roller 147*a* and a driven roller 147*b*. The driving roller 147*a* is driven to rotate by a conveyance motor (not shown). The driven roller 147*b* is configured to rotate in accordance with the rotation of the driving roller 147*a*. Likewise, the downstream rollers 148 include a driving roller 148*a* and a driven roller 148*b*. It is noted that plate members may be employed instead of the driven rollers 147*b* and 148*b*. In this case, each of the driving rollers 147*a* and 148*a* may hold a sheet with a corresponding one of the plate members.

The sheet table 141 is disposed in such a position as to face the nozzle-formed surface 111 of the print head 110 in the Z-axis direction, between the upstream rollers 147 and the downstream rollers 148 in the conveyance direction. The plurality of pressing members 146 are disposed between the upstream rollers 147 and the print head 110 in the conveyance direction.

Figure 5A:
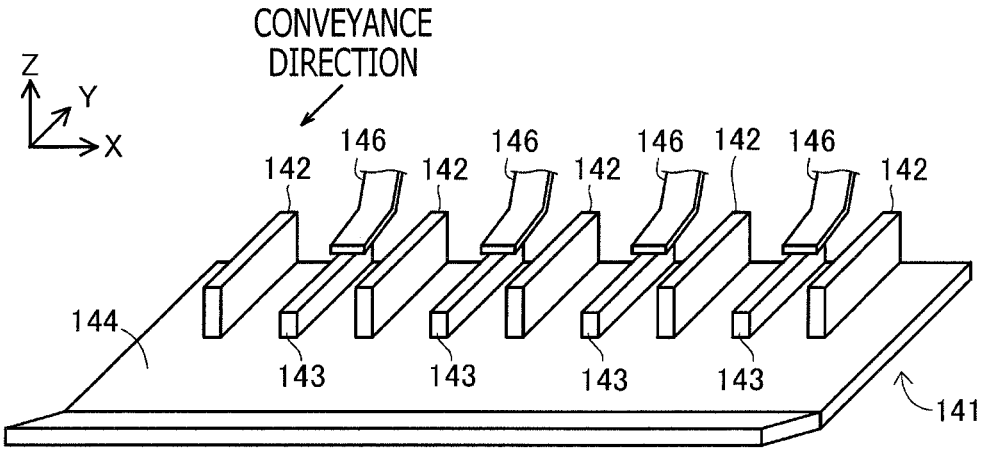
FIG. 5A is a perspective view schematically showing a configuration of the conveyor in the illustrative embodiment according to one or more aspects of the present disclosure.
Figure 5B:
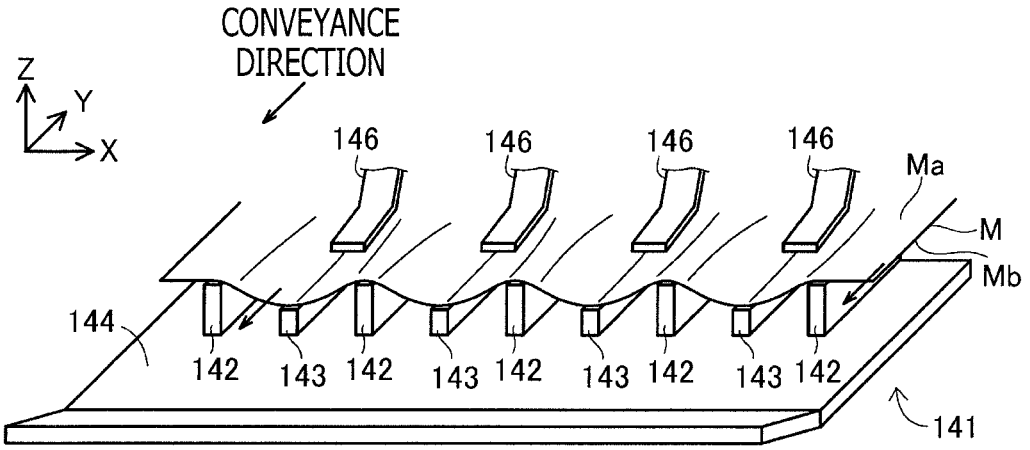
FIG. 5B is a perspective view schematically showing the conveyor conveying a sheet, in the illustrative embodiment according to one or more aspects of the present disclosure.

FIGS. 5A and 5B are perspective views showing the sheet table 141 and the plurality of pressing members 146. FIG. 5A shows a state where there is no sheet M held by the sheet table 141 and the plurality of pressing members 146. FIG. 5B shows a state where a sheet M is held by the sheet table 141 and the plurality of pressing members 146. The sheet table 141 includes a plurality of high supporting members 142, a plurality of low supporting members 143, and a flat plate 144.

The flat plate 144 is substantially parallel to the main scanning direction (i.e., the X-axis direction) and the conveyance direction (opposite to the Y-axis direction). An upstream end of the flat plate 144 in the conveyance direction is positioned close to the upstream rollers 147. A downstream end of the flat plate 144 in the conveyance direction is positioned close to the downstream rollers 148.

As shown in FIG. 5A, the plurality of high supporting members 142 and the plurality of low supporting members 143 are alternately arranged along the X-axis direction on the flat plate 144. Namely, each low supporting member 143 is disposed between two high supporting members adjacent thereto in the X-axis direction. Each of the supporting members 142 and 143 is a rib extending along the Y-axis direction. As shown in FIG. 4A, an upstream end of each high supporting member 142 in the conveyance direction is positioned at an upstream end of the flat plate 144 in the conveyance direction. A downstream end of each high supporting member 142 in the conveyance direction is positioned at a middle portion of the flat plate 144 in the conveyance direction. Both ends of each low supporting member 143 in the conveyance direction are in substantially the same positions as both ends of each high supporting member 142 in the conveyance direction are located, respectively.

The plurality of pressing members 146 are disposed downstream of the plurality of low supporting members 143 in the Z-axis direction. In other words, the plurality of pressing members 146 are disposed in a position higher than the plurality of low supporting members 143 in the vertical direction. Respective positions of the plurality of pressing members 146 in the X-axis direction are substantially the same as corresponding positions of the plurality of low supporting members 143 in the X-axis direction. Namely, each pressing member 146 is positioned between two high supporting members 142 adjacent thereto in the X-axis direction. Each pressing member 146 is slanted to be closer to the corresponding low supporting member 143 toward the downstream end thereof in the conveyance direction. The downstream end of each pressing member 146 in the conveyance direction is positioned between the upstream end of the print head 110 and the upstream rollers 147 in the conveyance direction.

As shown in FIG. 5B, while the sheet M is being conveyed, the plurality of high supporting members 142 and the plurality of low supporting members 143 support the sheet M from a side of a surface Mb opposite to a printed surface Ma of the sheet M. Further, the plurality of pressing members 146 support the sheet M from a side of the printed surface Ma. Thus, the plurality of high supporting members 142, the plurality of low supporting members 143, and the plurality of pressing members 146 hold the sheet M to deform the sheet M in a wave shape along the X-axis direction, at a location to face the nozzle-formed surface 111 of the print head 110 in the Z-axis direction (see FIG. 5B). Then, the sheet M is conveyed downstream in the conveyance direction, in a state deformed in the wave shape. When deformed in the wave shape, the sheet M has an increased stiffness against deformation along the Y-axis direction. Consequently, it is possible to prevent the sheet M from being deformed in a warped shape along the Y-axis direction to bend up toward the print head 110 from the sheet table 141 or bend down toward the sheet table 141. When the sheet M is warped upward or downward, dot-formed positions on the sheet M are shifted from desired positions. This might cause deteriorated quality of a printed image, for instance, due to banding. Further, the sheet M, when warped upward, might come into contact with the print head 110 and be contaminated.

Figure 4B:
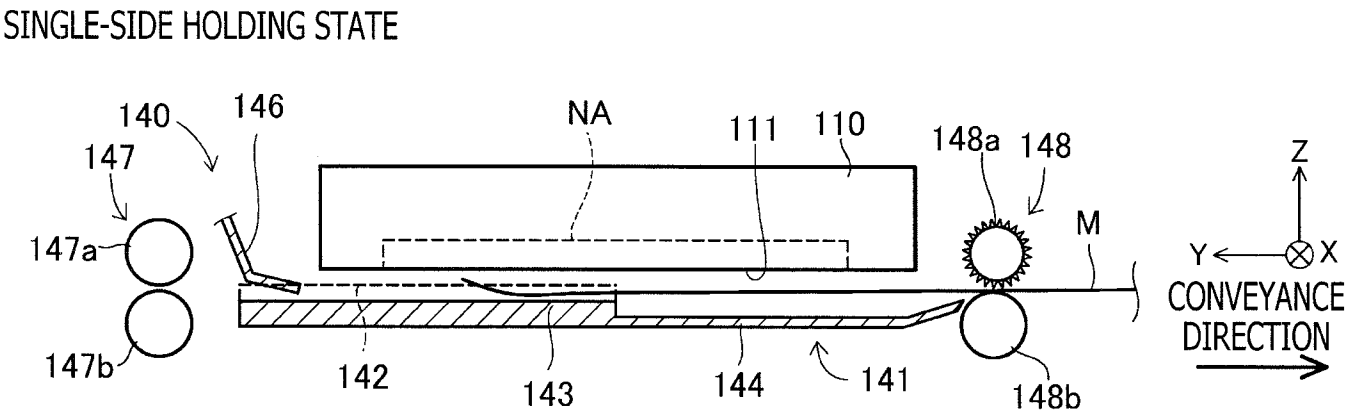
FIG. 4B is a side view, from the upstream side in the X-axis direction, schematically showing a single-side holding state where only a downstream side of the sheet in the conveyance direction is held by the conveyor, in the illustrative embodiment according to one or more aspects of the present disclosure.

FIG. 4A shows a both-side holding state where both sides of the sheet M in the conveyance direction are held. FIG. 4B shows a single-side holding state where only a downstream side of the sheet M in the conveyance direction is held. When an image is printed in an area near the upstream end of the single sheet M, a state of holding the sheet M is shifted from the both-side holding state as shown in FIG. 4A to the single-side holding state as shown in FIG. 4B.

The downstream rollers 148 (see FIG. 4A) may be referred to as "downstream holders," which are configured to hold the sheet M at a location downstream of the nozzles NZ of the print head 110 in the conveyance direction. The upstream rollers 147, the pressing members 146, and the low supporting members 143 (see FIG. 4A) may be referred to as "upstream holders," which are configured to hold the sheet M at a location upstream of the nozzles NZ of the print head 110 in the conveyance direction.

The both-side holding state shown in FIG. 4A is a state in which the sheet M is held by the downstream holders and the upstream holders. The single-side holding state shown in FIG. 4B is a state in which the sheet M is held by the downstream holders but not by the upstream holders.

A-2. Evacuation Positions and Flushing Positions

Evacuation positions and flushing positions, among positions in the main scanning direction to which the print head 110 is movable, will be described below. It is noted that when a simple expression "a position of the print head 110" is used in the following description, the expression may denote "a position of the print head 110 in the main scanning direction" or "a position of the print head 110 in the X-axis direction."

Figure 6A:
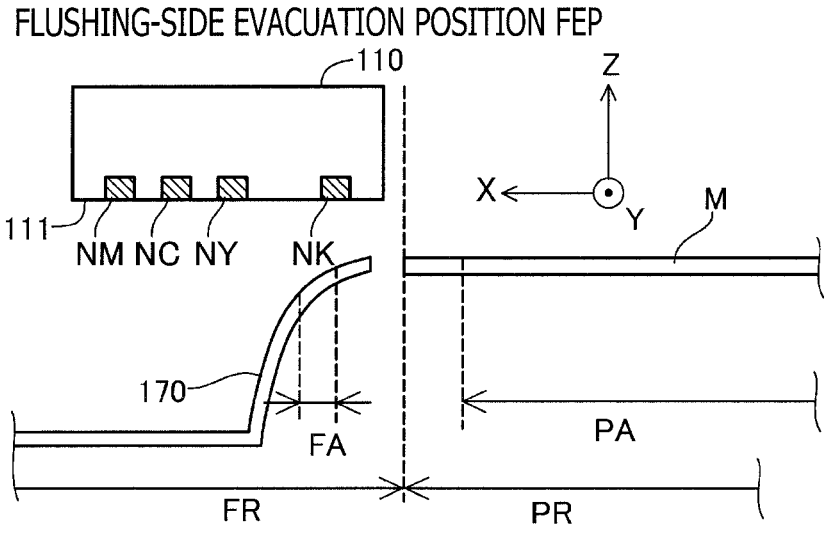
FIG. 6A is an illustration schematically showing the print head located in a flushing-side evacuation position, in the illustrative embodiment according to one or more aspects of the present disclosure.
Figure 6B:
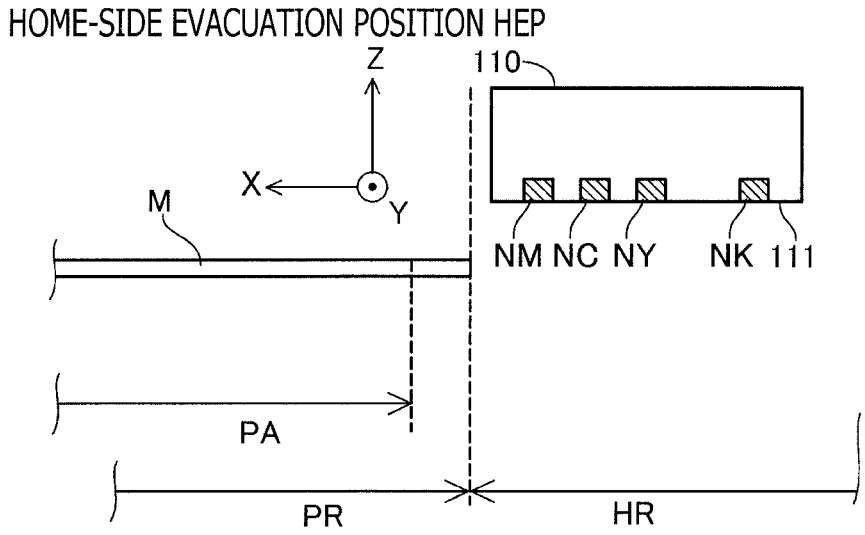
FIG. 6B is an illustration schematically showing the print head located in a home-side evacuation position, in the illustrative embodiment according to one or more aspects of the present disclosure.

FIGS. 6A to 6D are schematic illustrations for explaining positions of the print head 110. For the sake of simplification, each of FIGS. 6A to 6D only shows the print head 110, the sheet M, and the ink receiver 170, and other elements such as the carriage 133 are omitted. FIG. 6A shows the print head 110 in a flushing-side evacuation position FEP. In the flushing-side evacuation position FEP, the print head 110 is entirely positioned within a flushing range FR that is located downstream of a sheet range PR in the X-axis direction. FIG. 6B shows the print head 110 in a home-side evacuation position HEP. In the home-side evacuation position HEP, the print head 110 is entirely positioned within a home range HR that is located upstream of the sheet range PR in the X-axis direction. When the print head 110 is in one of the evacuation positions FEP and HEP, even though the sheet M is warped or bent due to ink soaking into the sheet M, it is possible to prevent even a part of the sheet M from contacting the nozzle-formed surface 111 or the nozzles NZ of the print head 110. If at least a part of the sheet M comes into contact with the nozzle-formed surface 111 and/or the nozzles NZ, it might cause a problem that the sheet M is contaminated with ink and/or a problem that the nozzles NZ are damaged.

Figure 6C:
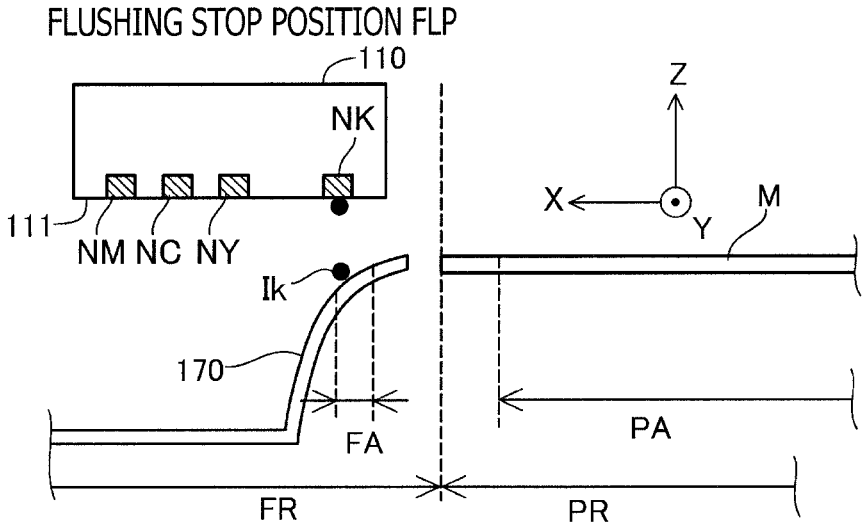
FIG. 6C is an illustration schematically showing the print head located in a flushing stop position, in the illustrative embodiment according to one or more aspects of the present disclosure.

FIG. 6C shows the print head 110 in a flushing stop position FLP. The flushing stop position FLP is a most downstream one of, in the X-axis direction, positions where flushing is possible. It is noted that "flushing" is an operation of discharging ink from each of the plurality of nozzles NZ onto a portion within a flushing area FA of the ink receiver 170. Thereby, it is possible to avoid nozzle clogging. The nozzle clogging might cause a failure that no ink or only a smaller amount of ink than expected is discharged from the nozzles NZ.

As shown in FIG. 6C, the ink receiver 170 is inclined to be lower toward a downstream side thereof in the X-axis direction. Ink Ik, after discharged onto a portion within the flushing area FA (see FIG. 6C), flows downward (i.e., upstream in the Z-axis direction) along a surface of the ink receiver 170. When ink Ik is discharged toward a portion downstream of the flushing area FA in the X-axis direction, a distance between the nozzles NZ and the portion of the ink receiver 170 is excessively long. Such a long distance might cause a failure that the ink Ik is decelerated by air resistance before reaching the ink receiver 170 and stays suspended in a housing of the printer 200. When ink Ik is discharged toward a portion upstream of the flushing area FA in the X-axis direction, a distance between the nozzles NZ and the portion of the ink receiver 170 is excessively short. Such a short distance might cause a failure that the ink Ik rebounds after landing on the portion of the ink receiver 170 and adheres onto the nozzle-formed surface 111. Therefore, the flushing area FA is set to be relatively narrow in the X-axis direction. In the flushing stop position FLP shown in FIG. 6C, the print head 110 is allowed to perform flushing for the nozzle row NK that is the most upstream one of the nozzle rows NK, NY, NC, and NM in the X-axis direction.

Figure 6D:
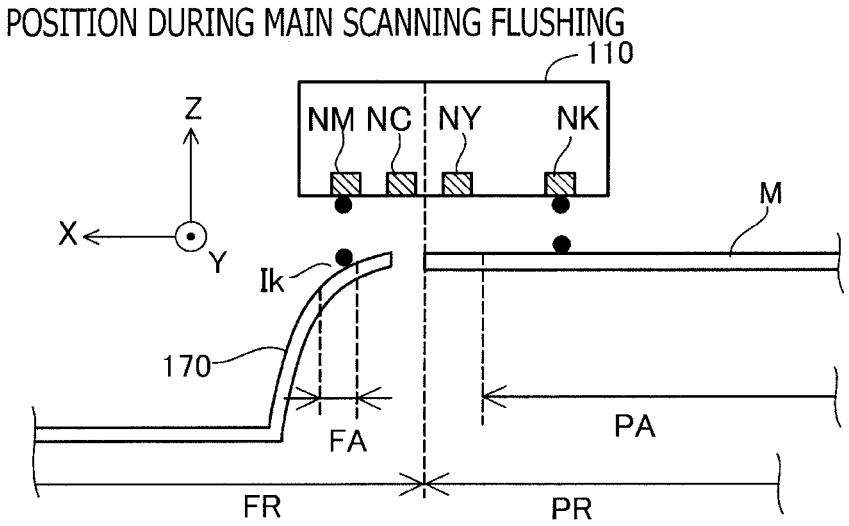
FIG. 6D is an illustration schematically showing the print head located in a position during main scanning flushing, in the illustrative embodiment according to one or more aspects of the present disclosure.

FIG. 6D shows an example of the print head 110 located in a position where the print head 110 is performing main scanning flushing. The "main scanning flushing" is a process of, while performing main scanning, performing flushing to discharge ink Ik from nozzles NZ located in such positions that the ink Ik is likely to land within the flushing area FA. When in the position shown in FIG. 6D, the print head 110 is allowed to perform flushing for the nozzle row NM that is the most downstream one of the nozzle rows NK, NY, NC, and NM in the X-axis direction. For instance, the print head 110 may perform flushing for all of the nozzle rows NK, NY, NC, and NM in the same order as cited, while performing main scanning from the flushing stop position FLP shown in FIG. 6C to the position shown in FIG. 6D in an upstream direction along the X-axis direction. Hereinafter, this flushing may be referred to as "flushing during the upstream main scanning." In another instance, the print head 110 may perform flushing for all of the nozzle rows NM, NC, NY, and NK in the same order as cited, while performing main scanning from the position shown in FIG. 6D to the flushing stop position FLP shown in FIG. 6C in a downstream direction along the X-axis direction. Hereinafter, this flushing may be referred to as "flushing during the downstream main scanning."

The ink receiver 170 is disposed in a position near the sheet range PR within the flushing-side range FR. Therefore, when the print head 110 is in the position shown in FIG. 6D, a downstream portion, including the nozzle row NM, of the print head 110 in the X-axis direction is positioned within the flushing-side range FR in the X-axis direction. Further, in this case, an upstream portion, including the nozzle row NK, of the print head 110 in the X-axis direction is positioned within the sheet range PR in the X-axis direction. Thus, when in the position shown in FIG. 6D, the print head 110 may form dots on the sheet M by discharging ink Ik from the nozzle row NK to the sheet M, while performing flushing to discharge ink Ik from the nozzle row NM to the ink receiver 170.

A-3. Overview of Printing

The CPU 210 controls the head driver 120, the main scanning mechanism 130, and the conveyor 140 to alternately and repeatedly perform partial printing SP and sheet conveyance TR, thereby performing printing with the print head 110. In a single operation of the partial printing SP, the CPU 210 causes the print head 110 to discharge ink from the nozzles NZ onto the sheet M while performing a single operation of the main scanning MS with the sheet M stopped on a platen, thereby forming on the sheet M a part of an image to be printed. In a single operation of the sheet conveyance TR, the CPU 210 causes the conveyor 140 to convey the sheet M over a particular conveyance distance in the conveyance direction AR. The conveyance distance may be a nozzle length D.

Figure 7:
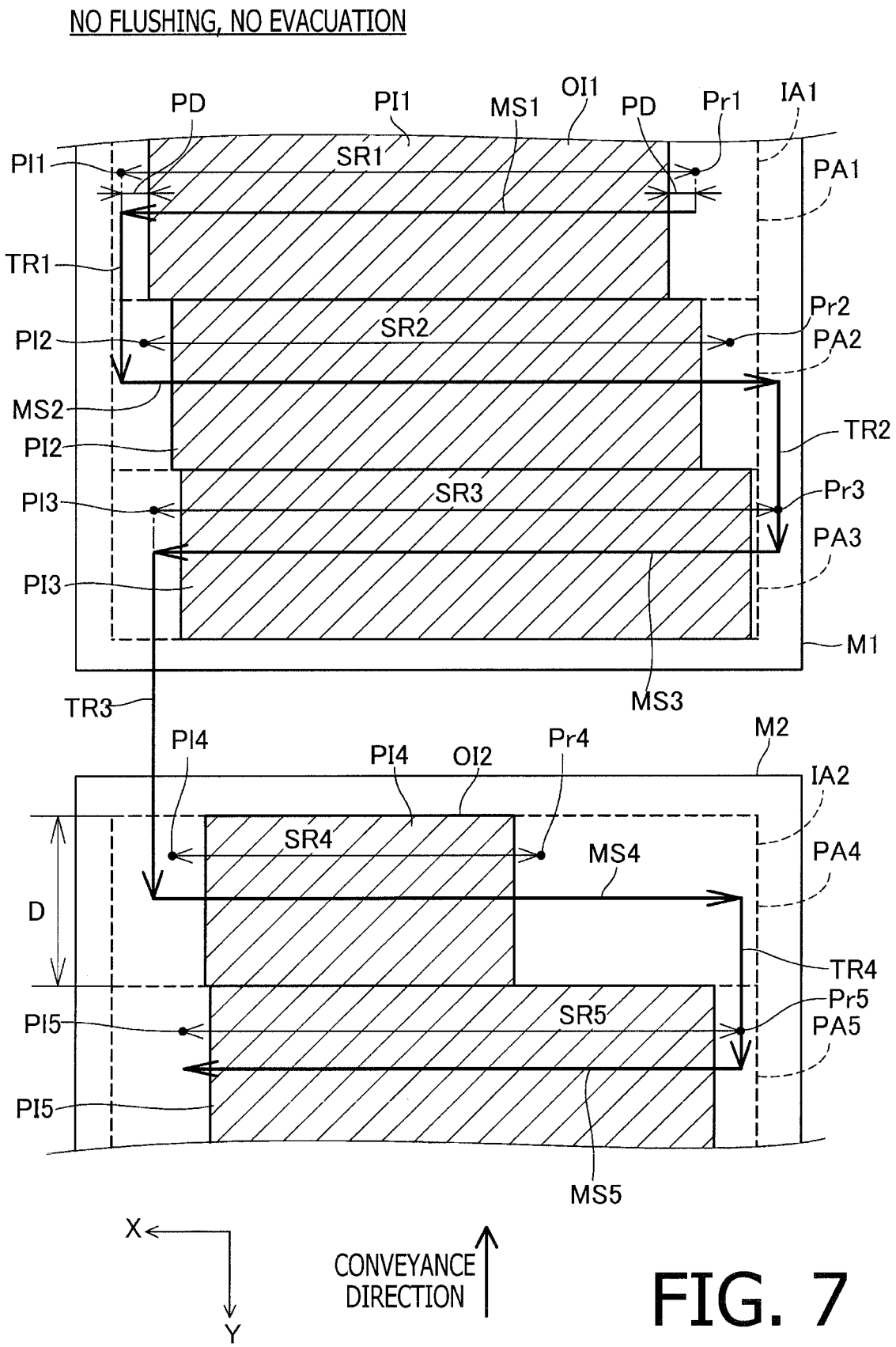
FIG. 7 is an illustration for explaining printing by the print mechanism, in the illustrative embodiment according to one or more aspects of the present disclosure.

FIG. 7 is an illustration for explaining printing by the print mechanism 100. FIG. 7 shows a first print image OI1 of a first page and a second print image OI2 of a second page. The second print image OI2 is printed on a second sheet M2 after the first print image OI1 has been printed on a first sheet M1. FIG. 7 further shows a printable area IA1 of the first sheet M1 and a printable area IA2 of the second sheet M2.

The first print image OI1 includes a plurality of partial images PI1 to PI3. The second print image OI2 includes a plurality of partial images PI4 to PI5. Each partial image is an image to be printed in a single operation of the partial printing SP. A printing direction of each single operation of the partial printing SP is one of a flushing position direction and a home position direction. The flushing position direction (hereinafter, which may be referred to as the "FL direction") is a direction from the home-side range HR toward the flushing-side range FR across the sheet range PR. The home position direction (hereinafter, which may be referred to as the "HP direction") opposite to the FL direction is a direction from the flushing-side range FR toward the home-side range HR across the sheet range PR. Each single operation of the partial printing SP is one of partial printing SP to form dots by performing main scanning in the FL direction (i.e., the downstream direction along the X-axis direction) and partial printing SP to form dots by performing main scanning in the HP direction (i.e., the upstream direction along the X-axis direction).

Partial printing SP for printing a partial image PIk ("k" represents one of integers from 1 to 5) will be referred to as a "partial printing operation SPk." Sheet conveyance TR to be performed between the partial printing operation SPk and the partial printing operation SP(k+1) will be referred to as a "sheet conveyance operation TRk." An area printable in the partial printing operation SPk will be referred to as a "partial area PAk."

FIG. 7 indicates respective main scanning operations MS1 to MS5 for partial printing operations SP1 to SP5, by corresponding arrows along the X-axis direction. An orientation of each arrow represents a scanning direction of a corresponding one of the main scanning operations MS1 to MS5. The scanning direction of each of the main scanning operations MS1 to MS5 is one of the FL direction (i.e., the downstream direction along the X-axis direction) and the HP direction (i.e., the upstream direction along the X-axis direction).

FIG. 7 further indicates respective sheet conveyance operations TR1 to TR4 to be performed after the partial printing operations SP1 to SP4, by corresponding arrows along the Y-axis direction. A conveyance distance for each of the sheet conveyance operations TR1, TR2, and TR4 is the nozzle length D. FIG. 7 further indicates respective partial areas PA1 to PA5 for the partial printing operations SP1 to SP5.

In the present disclosure, the partial image PIk represents an image formed by dots on the sheet M1 or the sheet M2. Therefore, portions having a background color (e.g., white) of the sheets M1 and M2 are not included in the partial image PIk. In FIG. 7, for the sake of simplification, a rectangular area from an upstream end to a downstream end of the partial image PIk in the X-axis direction, included in the partial area PAk, is indicated by hatching as the partial image PIk.

The partial printing operation SP3 for printing the partial image PI3 is a final partial printing operation on the first sheet M1. The sheet conveyance operation TR3 to be performed after the partial printing operation SP3 includes discharging the first sheet M1 and feeding the second sheet M2 to be printed after the first sheet M1. The partial printing operation SP4 for printing the partial image PI4 is a first partial printing operation (i.e., an initial partial printing operation) SP on the second sheet M2.

As understood from the scanning directions of the main scanning operations MS1 to MS5 shown in FIG. 7, the printer 200 of the illustrative embodiment is configured to perform bidirectional printing including the partial printing operations SP1, SP3, and SP5 in the FL direction and the partial printing operations SP2 and SP4 in the HP direction. The bidirectional printing makes a period of time for printing shorter, for instance, than unidirectional printing to repeatedly perform only a partial printing operation in the FL direction. In the unidirectional printing, after a partial printing operation in the FL direction, a next partial printing operation is performed in the same FL direction. Hence, to perform the next partial printing operation in the FL direction, the print head 110 needs to move in the HP direction without performing a partial printing operation. Meanwhile, in the bidirectional printing, there is no need for the print head 110 to move in the HP direction without performing a partial printing operation, in preparation for the next partial printing operation.

A-4. Printing Process

Figure 8:
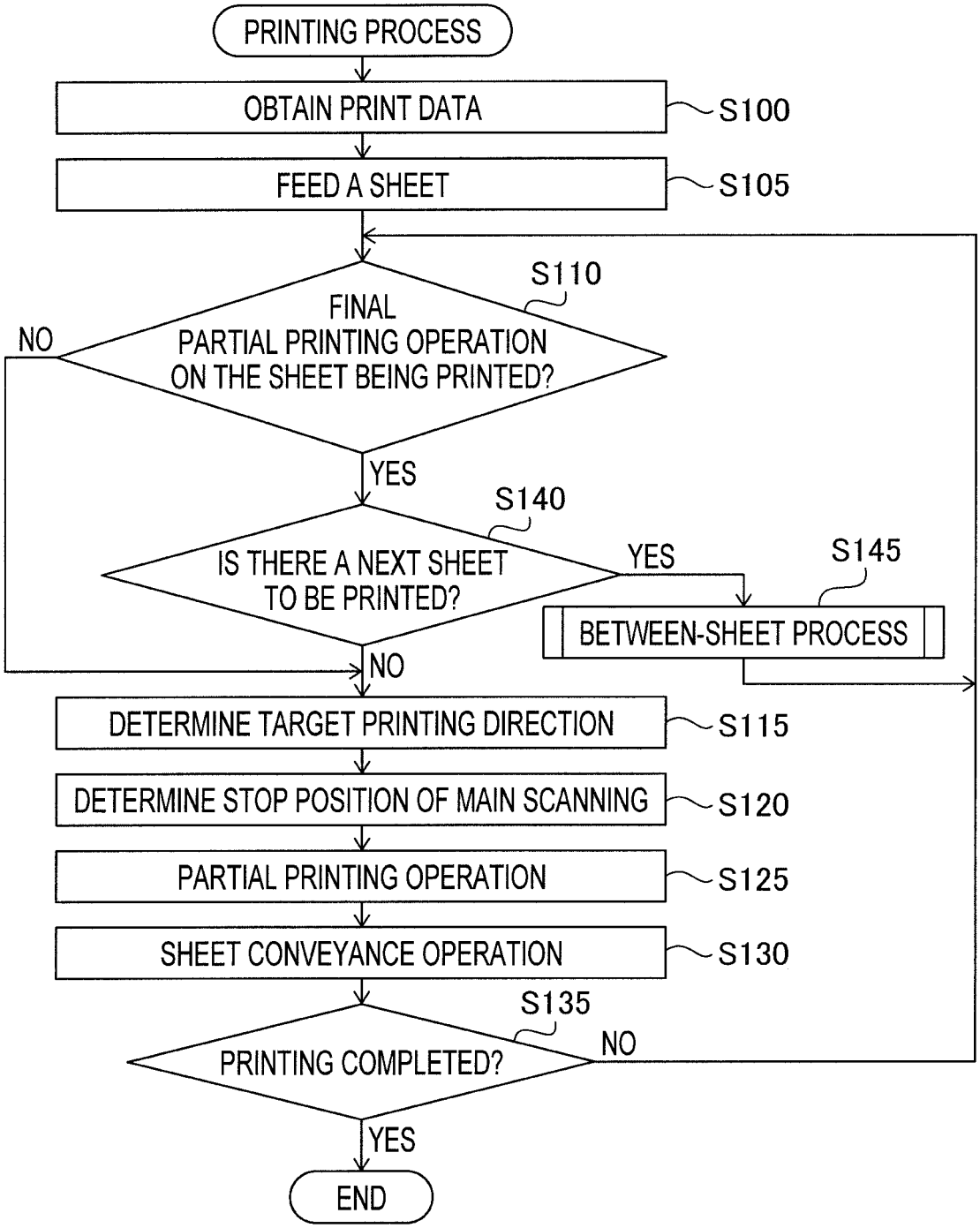
FIG. 8 is a flowchart showing a procedure of a printing process in the illustrative embodiment according to one or more aspects of the present disclosure.

FIG. 8 is a flowchart showing a procedure of a printing process in the illustrative embodiment. For instance, the CPU 210 of the printer 200 may start the printing process in response to receiving a print instruction from the terminal device 300 (see FIG. 1).

In S100, the CPU 210 obtains print data by receiving the print data from the terminal device 300 via the communication I/F 280. For instance, the print data may contain dot data representing a dot formation state for each color component of each pixel. For instance, the dot formation state may represent one of "dot formed" and "no dot." In another instance, the dot formation state may represent one of "large-sized dot," "middle-sized dot," "small-sized dot," and "no dot." In the illustrative embodiment, the print data contains dot data representing a plurality of pages of images to be printed on a plurality of sheets M.

In S105, the CPU 210 controls the conveyor 140 to perform sheet feeding to convey a sheet M from a feed tray (not shown) to a particular initial position.

In S110, the CPU 210 determines whether a next partial printing operation SP (hereinafter, which may be referred to as a "target partial printing operation") to be performed is a final partial printing operation on a sheet M currently being printed. For instance, when the target partial printing operation is the partial printing operation SP3 to print the partial image PI3 in FIG. 7, the target partial printing operation is determined to be the final partial printing operation on the sheet M currently being printed.

When determining that the target partial printing operation is the final partial printing operation (S110: Yes), the CPU 210 goes to S140. In S140, the CPU 210 determines whether to perform printing on a next sheet M after printing on the current sheet M. For instance, when the target partial printing operation is the partial printing operation SP3 to print the partial image PI3, the second print image OI2 should be printed on the second sheet M. Therefore, in this case, the CPU 210 determines to perform printing on a next sheet M after printing on the current sheet M.

When determining to perform printing on a next sheet M after printing on the current sheet M (S140: Yes), the CPU 210 goes to S145. In S145, the CPU 210 performs a between-sheet process. In the between-sheet process, the CPU 210 controls the print mechanism 100 to perform the final partial printing operation SP on the sheet M (e.g., the first sheet M1) currently being printed and perform a first partial printing operation (i.e., an initial partial printing operation) SP on a next sheet M (e.g., the second sheet M2). The between-sheet process will be described in detail later. After completion of the between-sheet process, the CPU 210 goes back to S110.

When determining that the target partial printing operation is not the final partial printing operation (S110: No) or determining not to perform printing on a next sheet M (S140: No), the CPU 210 goes to S115. In S115, the CPU 210 determines a target printing direction to be an opposite direction to a printing direction for the last partial printing operation.

In S120, the CPU 210 determines a stop position of main scanning for the target partial printing operation. Specifically, the CPU 210 first specifies a downstream end of a main scanning range SR for the target partial printing operation in the target printing direction. The main scanning range SR is a range of a main scanning operation MS required for printing a partial image PI in a partial printing operation. In the X-axis direction, a main scanning range SR for printing a target partial image has an upstream end that is positioned a particular length PD upstream of an upstream end of the target partial image. Further, in the X-axis direction, the main scanning range SR for printing the target partial image has a downstream end that is positioned the particular length PD upstream of a downstream end of the target partial image. FIG. 7 shows respective main scanning ranges SR1 to SR5 for printing the partial images PI1 to PI5. Points Pl1 to Pl5 indicates downstream ends (left ends in FIG. 7) of the main scanning ranges SR1 to SR5 in the X-axis direction, respectively. Points Pr1 to Pr5 indicates upstream ends (right ends in FIG. 7) of the main scanning ranges SR1 to SR5 in the X-axis direction, respectively. For instance, as shown in FIG. 7, the main scanning range SR1 for printing the partial image PI1 is wider, by the particular length PD at each end, than the partial image PI1 in the X-axis direction. The particular length PD is a moving distance necessary for the stopped print head 110 to accelerate to a moving speed required for a partial printing operation at the start of the main scanning for the partial printing operation.

When the main scanning range SR for the target partial printing operation is the main scanning range SR1 in FIG. 7, the target printing direction is the FL direction. Therefore, in this case, the CPU 210 specifies the downstream end Pl1 of the main scanning range SR1 in the X-axis direction. The CPU 210 specifies a downstream end, in the target printing direction, of a main scanning range SR of a next partial printing operation after the target partial printing operation. Specifically, for instance, when the main scanning range SR of the target partial printing operation is the main scanning range SR1 in FIG. 7, the CPU 210 specifies the downstream end Pl2 of the main scanning range SR2 in the X-axis direction. Then, the CPU 210 determines a position of a downstream one of the two specified ends in the target printing direction as the stop position of the main scanning for the target partial printing operation. Specifically, for instance, when the main scanning range SR of the target partial printing operation is the main scanning range SR1 in FIG. 7, the downstream end Pl1 of the main scanning range SR1 in the X-axis direction is positioned downstream of the downstream end Pl2 of the main scanning range SR2 in the FL direction. Therefore, in this case, the CPU 210 determines a position of the downstream end Pl1 of the main scanning range SR1 in the X-axis direction as the stop position of the main scanning operation MS1.

Further, for instance, when the main scanning range SR of the target partial printing operation is the main scanning range SR2 in FIG. 7, the CPU 210 makes a comparison between the upstream end Pr2 of the main scanning range SR2 and the upstream end Pr3 of the main scanning range SR3 in the X-axis direction. The upstream end Pr3 of the main scanning range SR3 in the X-axis direction is positioned downstream, in the HP direction, of the upstream end Pr2 of the main scanning range SR2 in the X-axis direction. Therefore, in this case, the CPU 210 determines a position of the upstream end Pr3 of the main scanning range SR3 in the X-axis direction as the stop position of the main scanning operation MS2.

In S125, the CPU 210 causes the print mechanism 100 to perform the target partial printing operation by using dot data representing the partial image to be printed in the target partial printing operation among the print data. At this point of time, the print head 110 stops at a stop position of main scanning for a previous partial printing operation SP. Hence, the print mechanism 100 performs the target partial printing operation by discharging ink Ik from the nozzles NZ while performing the main scanning to move the print head 110 in the target printing direction from the stop position of the main scanning for the previous partial printing operation to the stop position of the main scanning for the target partial printing operation. In S130, the CPU 210 causes the print mechanism 100 to convey the sheet M only by the nozzle length D. For instance, when the target partial printing operation is the partial printing operation SP1 to print the partial image PI1 in FIG. 7, the CPU 210 causes the print mechanism 100 to perform the main scanning operation MS1 to print the partial image PI1 (S125) and then perform the sheet conveyance operation TR1 (S130).

In S135, the CPU 210 determines whether all of the partial printing operations have been completed. When determining that all of the partial printing operations have not been completed (S135: No), the CPU 210 goes back to S110. Meanwhile, when determining that all of the partial printing operations have been completed (S135: Yes), the CPU 210 terminates the printing process.

A-5. Between-Sheet Process

Subsequently, the between-sheet process in S145 (see FIG. 8) will be described. FIGS. 9A to 9D are flowcharts showing a procedure of the between-sheet process. In S205 (see FIG. 9A), the CPU 210 determines an opposite direction to a printing direction for a last partial printing operation, as the target printing direction for the target partial printing operation.

In S210, the CPU 210 calculates a dot formation number DN by using dot data representing a partial image to be printed in the target partial printing operation among the print data. The dot formation number DN is a total number of dots of CMYK to be formed in the target partial printing operation. In other words, the dot formation number DN is an index value representing an amount of ink to be used for the target partial printing operation.

In S215, the CPU 210 determines whether the target printing direction is the FL direction. When determining that the target printing direction is not the FL direction, i.e., that the target printing direction is the HP direction (S215: No), the CPU 210 goes to S305 (see FIG. 9C). Meanwhile, when determining that the target printing direction is the FL direction (S215: Yes), the CPU 210 goes to S220.

In S220, the CPU 210 determines whether a flushing execution condition is satisfied. For instance, when a time elapsed after the last flushing is equal to or more than a particular period of time (e.g., 10 seconds), the CPU 210 may determine that the flushing execution condition is satisfied. Instead, in another instance, when an amount of ink used after the last flushing is equal to or more than a particular amount, the CPU 210 may determine that the flushing execution condition is satisfied. In yet another instance, when a count of sheets printed after the last flushing is equal to or more than a particular number, the CPU 210 may determine that the flushing execution condition is satisfied. When determining that the flushing execution condition is satisfied (S220: Yes), the CPU 210 goes to S225. Then, the CPU 210 executes the steps S225 to S240 to perform flushing.

When determining that the flushing execution condition is not satisfied (S220: No), the CPU 210 goes to S245. Then, in S245 and S250, the CPU 210 determines whether to evacuate the print head 110 during the sheet conveyance operation TR after the target partial printing operation. The evacuation of the print head 110 is to move the print head 110 out of the sheet range PR. When the print head 110 is evacuated, even though the sheet M is excessively deformed due to ink Ik soaking into the sheet M, the deformed sheet M is prevented from contacting the nozzle-formed surface 111 of the print head 110. Therefore, when the sheet M is easily deformable, it is preferable to evacuate the print head 110. Meanwhile, when the sheet M is not so deformable, the print head 110 needs not necessarily be evacuated.

In S245, the CPU 210 determines whether a current holding state, that is, a holding state for holding the sheet M during the target partial printing operation is the single-side holding state (see FIG. 4B) or the both-side holding state (see FIG. 4A). For instance, when an upstream margin (e.g., a lower margin in FIG. 7) of the sheet M being printed in the conveyance direction AR is wider than a reference length, the final partial printing operation SP on the sheet M being printed may be performed in the both-side holding state. Meanwhile, when the upstream margin of the sheet M being printed in the conveyance direction AR is equal to or narrower than the reference length, the final partial printing operation SP on the sheet M being printed may be performed in the single-side holding state. When the current holding state is the single-side holding state (S245: Yes), the sheet M might be deformed depending on an amount of ink Ik discharged onto the sheet M. Therefore, in this case, in S250, the CPU 210 determines whether the dot formation number DN calculated in S210 is equal to or more than a threshold THd. When the dot formation number DN is equal to or more than the threshold THd (S250: Yes), the sheet M is deemed to be easily deformed due to ink Ik soaking into the sheet M. Hence, in this case, the CPU 210 evacuates the print head 110 and performs the steps S255 to S270 without performing flushing.

When the current holding state is the both-side holding state (S245: No), the sheet M is unlikely to be deformed regardless of the amount of the ink Ik discharged onto the sheet M. Further, even though the current holding state is the single-side holding state (S245: Yes), when the dot formation number DN is less than the threshold THd (S250: No), the sheet M is unlikely to be deformed. Hence, in this case, the CPU 210 performs the steps S275 to S290 without evacuating the print head 110 or performing flushing.

As understood from the above description, specific conditions, which are checked in S245 and S250 to determine whether to evacuate the print head 110, represent that when the specific conditions are satisfied, the sheet M being printed is more likely to be deformed than when at least one of the specific conditions is not satisfied. It is noted that hereinafter, the one of the specific conditions as checked in S245 may be referred to as the "first specific condition." Further, the other one of the specific conditions as checked in S250 may be referred to as the "second specific condition."

Figure 9A:
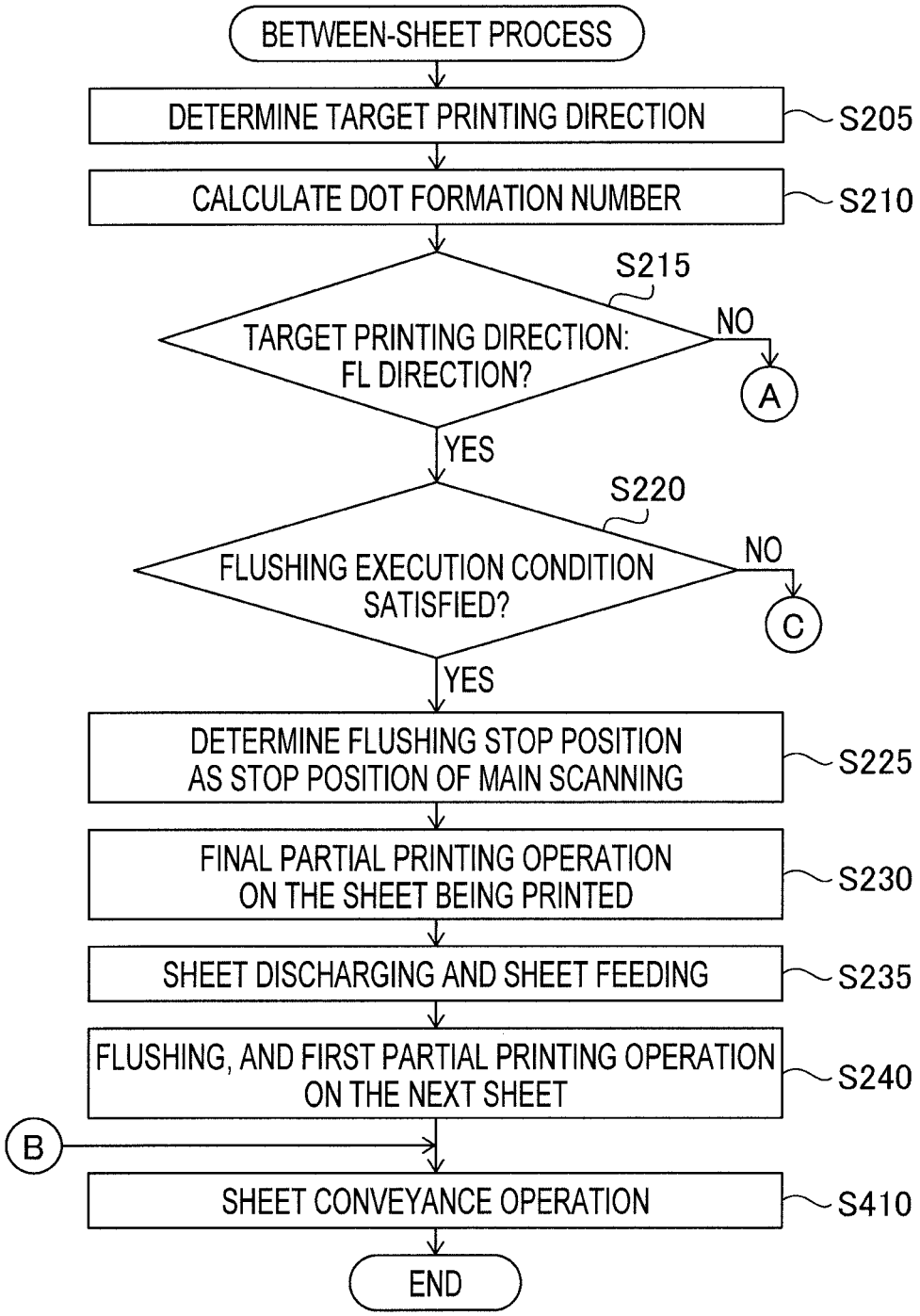
FIGS. 9A to 9D are flowcharts showing a procedure of a between-sheet process in the illustrative embodiment according to one or more aspects of the present disclosure.
Figure 10A:
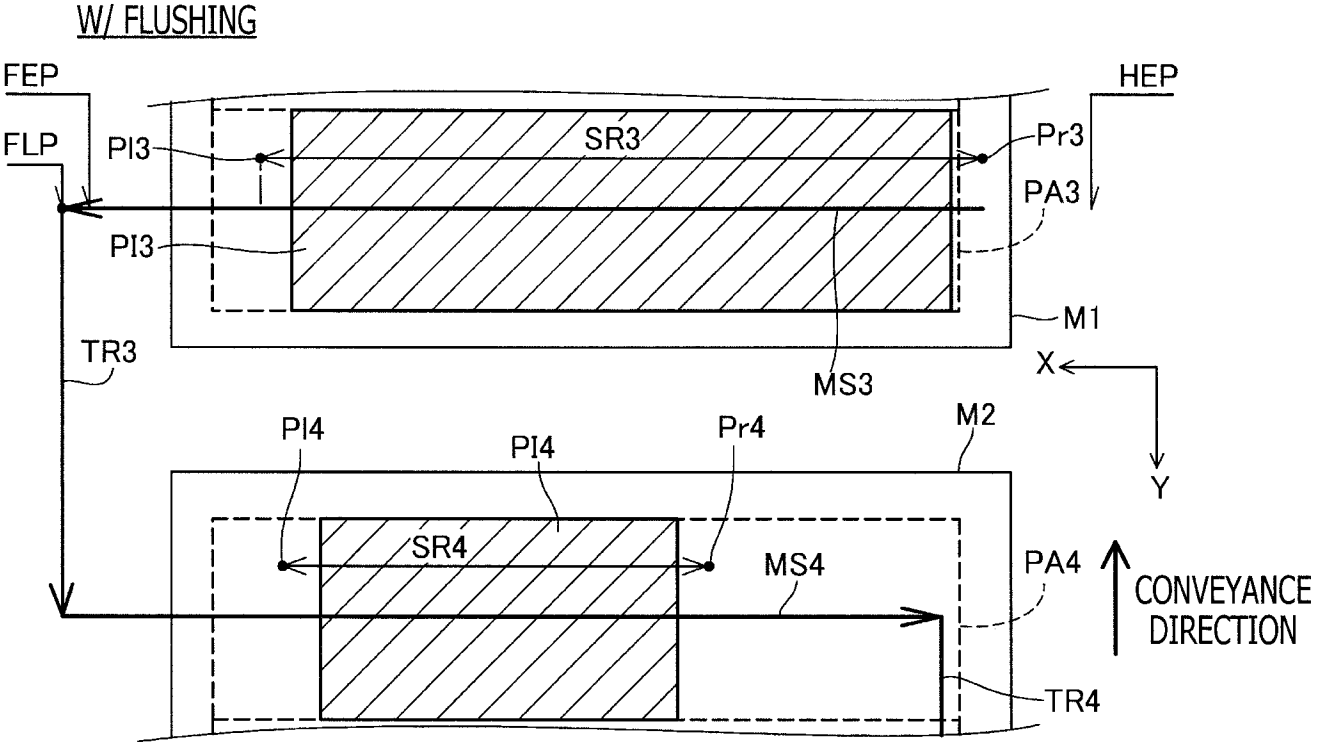
FIG. 10A illustrates a process of S225 to S240 in the between-sheet process in the illustrative embodiment according to one or more aspects of the present disclosure.
Figure 10B:
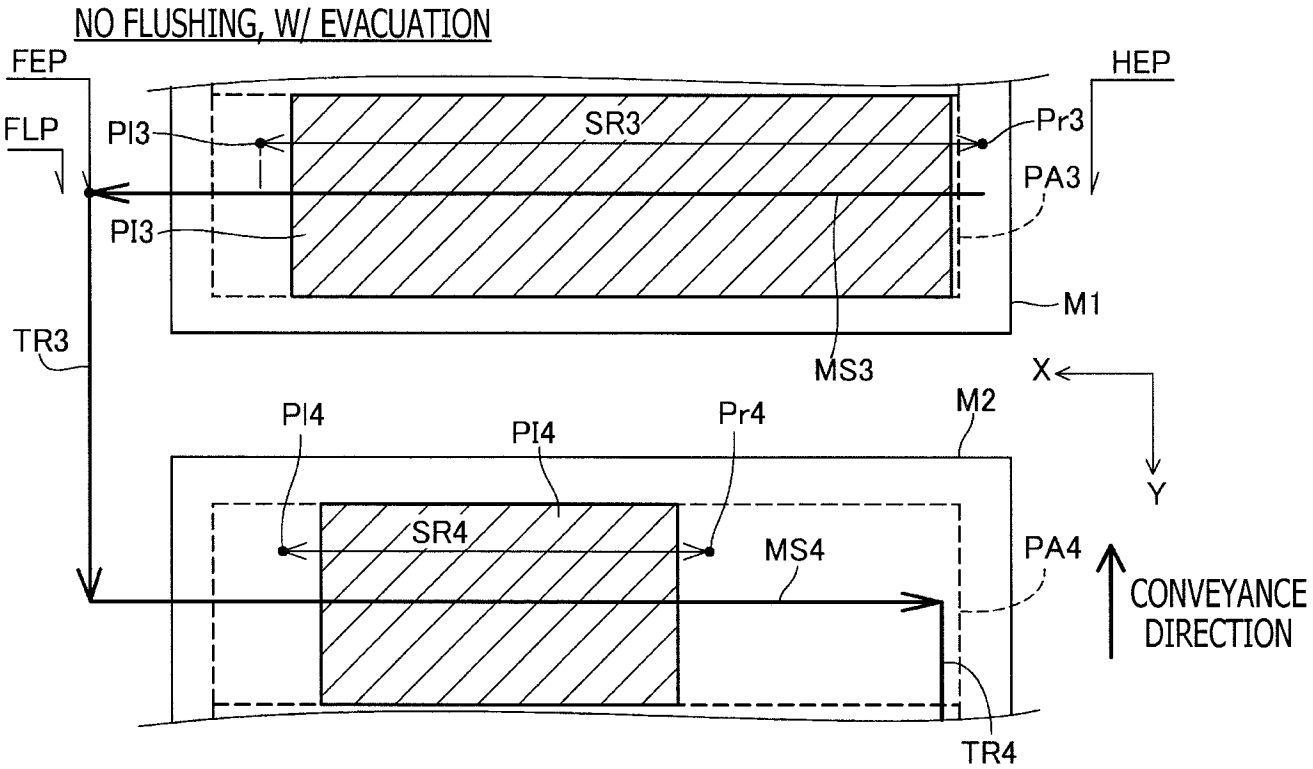
FIG. 10B illustrates a process of S255 to S270 in the between-sheet process in the illustrative embodiment according to one or more aspects of the present disclosure.

FIGS. 10A and 10B are a first set of illustrations for explaining the between-sheet process. FIG. 10A illustrates a process of S225 to S240 (see FIG. 9A) to perform flushing. In S225, the CPU 210 determines the stop position of the main scanning for the target partial printing operation as the flushing stop position FLP (see FIG. 6C). In S230, the CPU 210 causes the print mechanism 100 to perform the target partial printing operation, that is, the final partial printing operation SP on the sheet M being printed. In an example shown in FIG. 10A, the print mechanism 100 performs the final partial printing operation SP3 on the first sheet M1 while performing the main scanning operation MS3 in the FL direction. As shown in FIG. 10A, a stop position of the main scanning operation MS3 is the flushing stop position FLP.

In S235, the CPU 210 causes the print mechanism 100 to perform sheet discharging and sheet feeding. Specifically, as indicated as the sheet conveyance operation TR3 in the example of FIG. 10A, the print mechanism 100 discharges the first sheet M1 on which printing has been completed, and feeds the second sheet M2. In S240, the CPU 210 causes the print mechanism 100 to perform flushing and a first partial printing operation (i.e., an initial partial printing operation) SP on a next sheet M. In the example shown in FIG. 10A, the print mechanism 100 performs flushing (see FIGS. 6C and 6D) and the partial printing operation SP4 to print the partial image PI4 while performing the main scanning operation MS4 in the HP direction from the flushing stop position FLP.

Figure 9B:
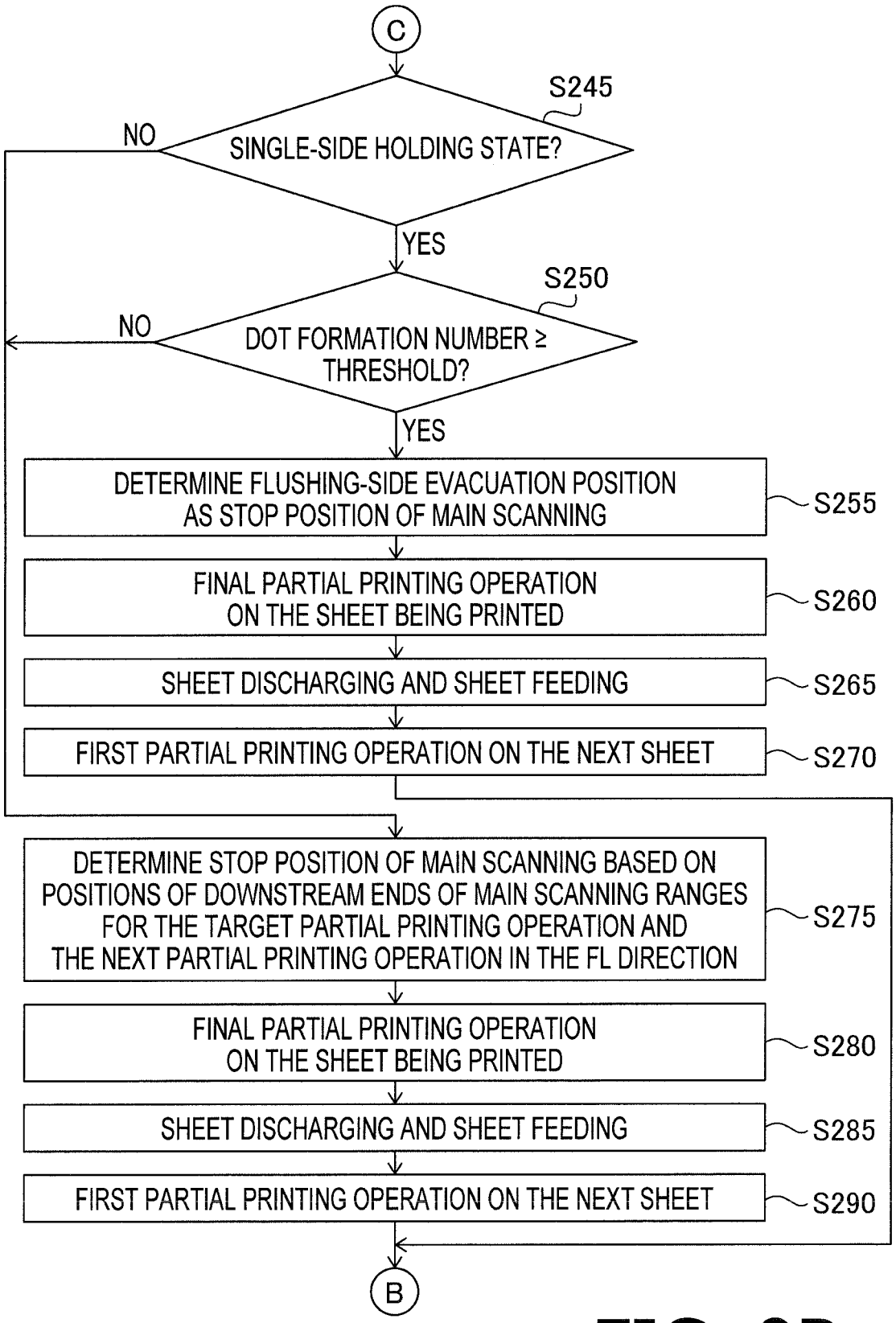

As understood from the flowcharts shown in FIGS. 9A and 9B, when determining that the flushing execution condition is satisfied (S220: Yes), the CPU 210 does not make such determinations as made in S245 and S250 to determine whether to evacuate the print head 110. This is because, in this case, the CPU 210 causes the print head 110 to move to the flushing stop position FLP to perform flushing, thereby evacuating the print head 110 out of the sheet range PR.

FIG. 10B illustrates a process of S255 to S270 to evacuate the print head 110 without performing flushing. In S255, the CPU 210 determines the flushing-side evacuation position FEP (see FIG. 6A) as the stop position of the main scanning for the target partial printing operation. In S260, the CPU 210 causes the print mechanism 100 to perform the target partial printing operation, that is, the final partial printing operation on the sheet M being printed. In an example shown in FIG. 10B, the print mechanism 100 performs the final partial printing operation SP3 on the first sheet M1 while performing the main scanning operation MS3 in the FL direction. As shown in FIG. 10B, the stop position of the main scanning operation MS3 is the flushing-side evacuation position FEP.

In S265, in the same manner as in S235, the CPU 210 causes the print mechanism 100 to perform sheet discharging and sheet feeding. Specifically, as indicated as the sheet conveyance operation TR3 in the example of FIG. 10B, the print mechanism 100 discharges the first sheet M1 on which printing has been completed, and feeds the second sheet M2. In S270, the CPU 210 causes the print mechanism 100 to perform the first partial printing operation SP on the next sheet M. In the example shown in FIG. 10B, the CPU 210 causes the print mechanism 100 to perform the partial printing operation SP4 to print the partial image PI4 while performing the main scanning operation MS4 in the HP direction from the flushing-side evacuation position FEP.

In the process of S255 to S270, the flushing-side evacuation position FEP is positioned upstream of the flushing stop position FLP in the X-axis direction. Hence, it is possible to shorten the moving distance of the print head 110 in each of the main scanning operations MS3 and MS4. Therefore, it is possible to make the period of time for printing shorter than when performing the process of S225 to S240 to perform flushing.

FIG. 7 illustrates a process of S275 to S290 without evacuating the print head 110 or performing flushing. In S275, the CPU 210 determines a stop position of the main scanning, based on positions of downstream ends of the main scanning ranges SR for the target partial printing operation and the next partial printing operation in the FL direction (i.e., based on positions of downstream ends of the main scanning ranges SR for the target partial printing operation and the next partial printing operation in the X-axis direction).

Specifically, the CPU 210 specifies a downstream end in the FL direction (i.e., a downstream end in the X-axis direction) of the partial image PI to be printed in the target partial printing operation. Then, the CPU 210 specifies a position that is located the particular length PD downstream of the specified downstream end of the partial image PI in the FL direction, as the downstream end of the main scanning range SR for the target partial printing operation in the FL direction. Further, the CPU 210 specifies a downstream end in the FL direction (i.e., a downstream end in the X-axis direction) of the partial image PI to be printed in the next partial printing operation. Then, the CPU 210 specifies a position that is located the particular length PD downstream of the specified downstream end of the partial image PI in the FL direction, as the downstream end of the main scanning range SR for the next partial printing operation in the FL direction. Thus, the CPU 210 determines a more downstream one, in the FL direction, of the downstream end of the main scanning range SR for the target partial printing operation in the FL direction and the downstream end of the main scanning range SR for the next partial printing operation in the FL direction, as the stop position of the main scanning for the target partial printing operation.

In the example shown in FIG. 7, the downstream end Pl3 of the main scanning range SR3 for the target partial printing operation (i.e., the final partial printing operation SP3 on the first sheet M1) in the X-axis direction is positioned downstream, in the X-axis direction, of the downstream end Pl4 of the main scanning range SR4 for the first partial printing operation SP4 on the second sheet M2 in the X-axis direction. Therefore, the downstream end Pl3 of the main scanning range SR3 in the X-axis direction is determined as the stop position of the main scanning for the target partial printing operation. In S280, the CPU 210 causes the print mechanism 100 to perform the target partial printing operation, i.e., the final partial printing operation SP on the sheet M being printed. In the example shown in FIG. 7, the print mechanism 100 performs the final partial printing operation SP3 on the first sheet M1 while performing the main scanning operation MS3 in the FL direction. As shown in FIG. 7, the stop position of the main scanning operation MS3 is the downstream end Pl3 of the main scanning range SR3 in the X-axis direction.

In S285, in the same manner as in S235, the CPU 210 causes the print mechanism 100 to perform sheet discharging and sheet feeding. Specifically, as indicated as the sheet conveyance operation TR3 in the example of FIG. 7, the print mechanism 100 discharges the first sheet M1 on which printing has been completed, and feeds the second sheet M2. In S290, the CPU 210 causes the print mechanism 100 to perform the first partial printing operation SP on the next sheet M. In the example shown in FIG. 7, the print mechanism 100 performs the partial printing operation SP4 to print the partial image PI4 while performing the main scanning operation MS4 in the HP direction from the downstream end PI3 of the main scanning range SR3 in the X-axis direction.

In the process of S275 to S290, in the target partial printing operation, the print head 110 is stopped in a position upstream of the flushing-side evacuation position FEP in the X-axis direction. Hence, it is possible to shorten the moving distance of the print head 110 in each of the main scanning operations MS3 and MS4. Therefore, it is possible to make the period of time for printing shorter than when performing the process of S255 to S270 to evacuate the print head 110.

Figure 9C:
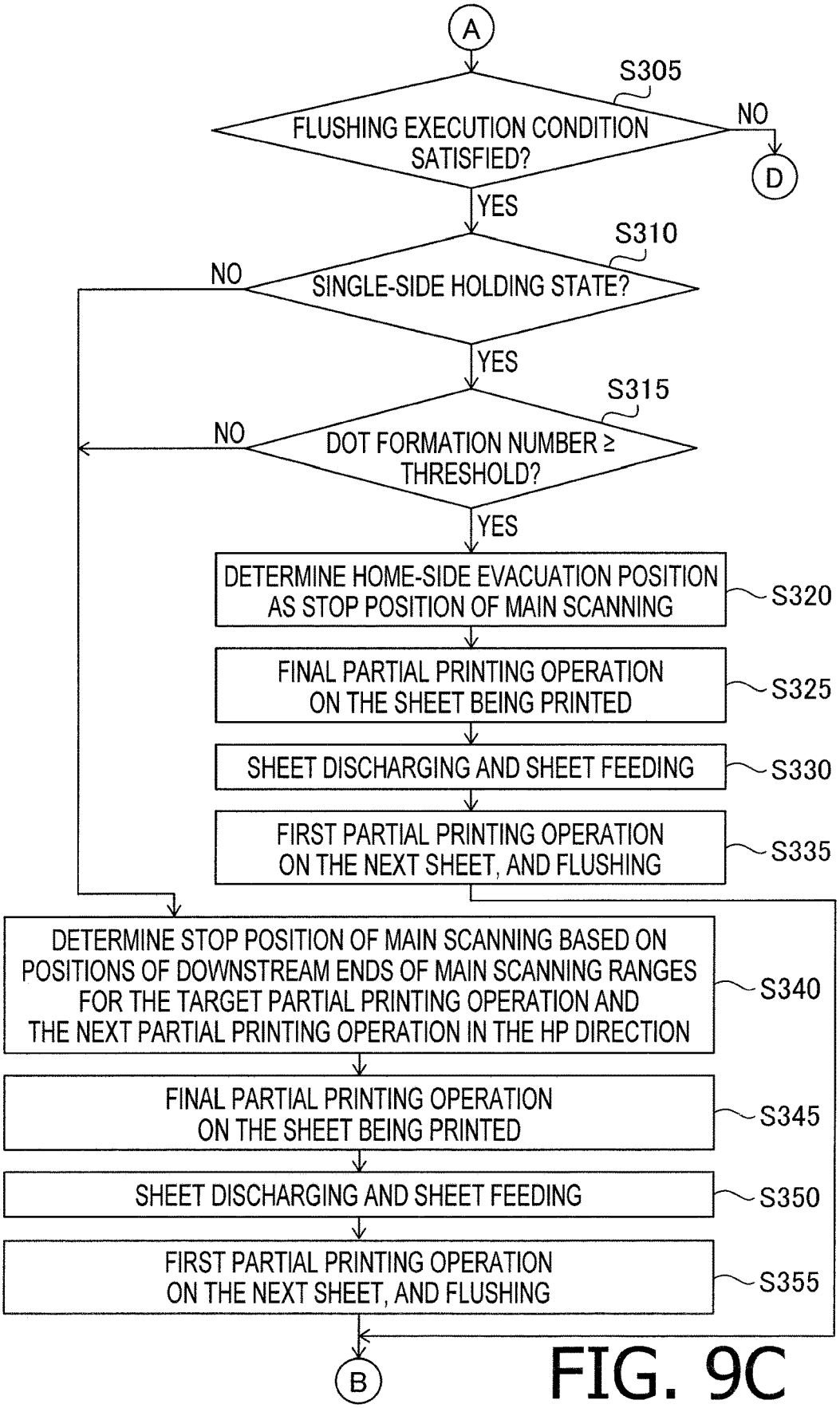
Figure 9D:
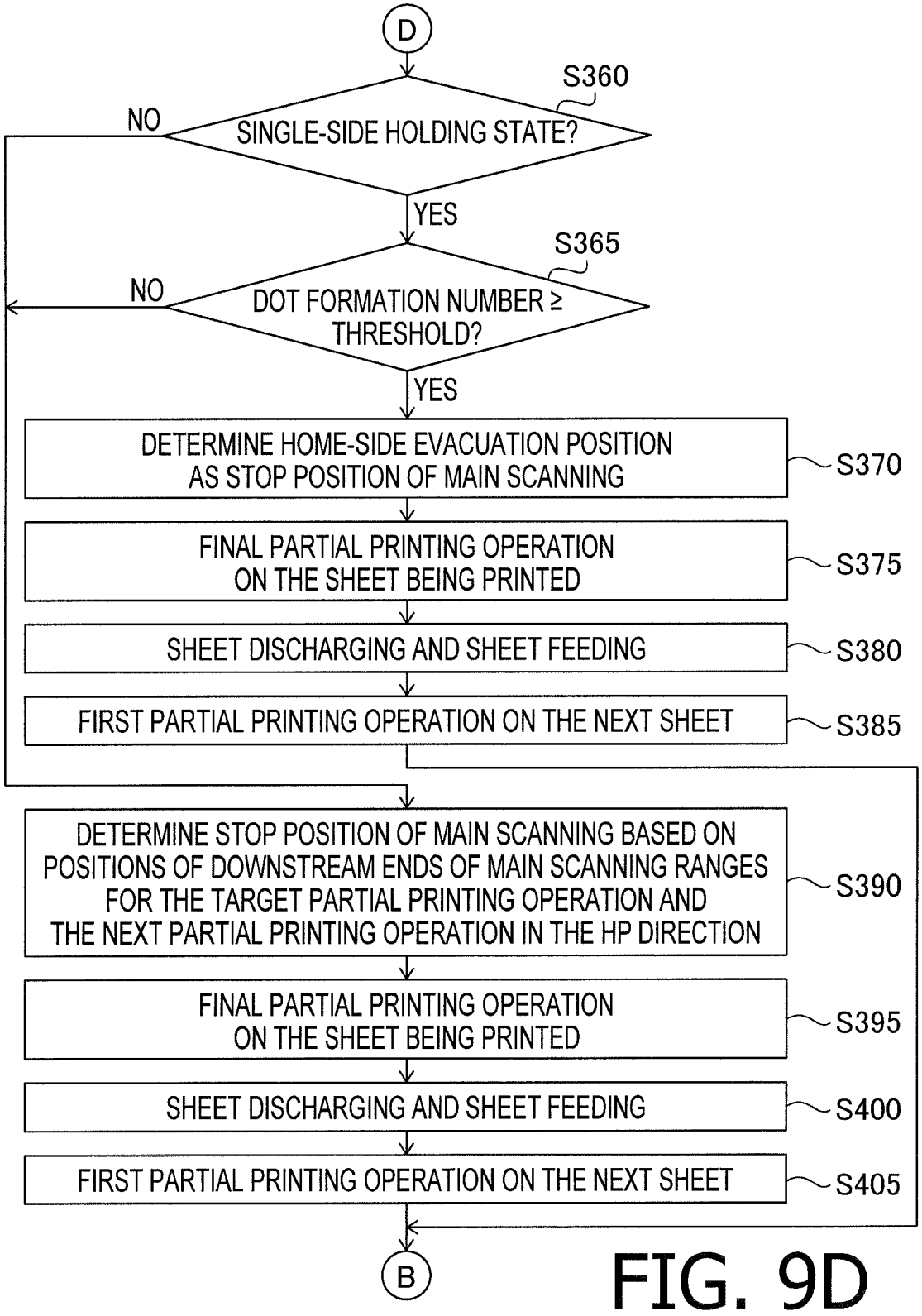

A process of S305 to S405 in FIGS. 9C and 9D is a process to be performed when the target printing direction (i.e., the printing direction for the final partial printing operation SP on the sheet M being printed) is the HP direction (S215: No).

In S305, in the same manner as in S220 (see FIG. 9A), the CPU 210 determines whether the flushing execution condition is satisfied. When determining that the flushing execution condition is satisfied (S305: Yes), in the same manner as in S245 and S250, the CPU 210 determines in S310 and S315 whether to evacuate the print head 110 in the sheet conveyance operation TR after the target partial printing operation. Thus, unlike when the target printing direction is the FL direction, even though the flushing execution condition is satisfied, the CPU 210 determines whether to evacuate the print head 110. This is because in the case where the target printing direction is the HP direction, as will be described, the print mechanism 100 performs flushing when the print head 110 moves toward the flushing stop position FLP in the first partial printing operation SP on the next sheet M, and therefore, there is no need to move the print head 110 to the flushing stop position FLP in the target partial printing operation.

In S310, the CPU 210 determines whether the current holding state, that is, the holding state for holding the sheet M during the target partial printing operation is the single-side holding state (see FIG. 4B) or the both-side holding state (see FIG. 4A). When determining that the current holding state is the single-side holding state (S310: Yes), the CPU 210 goes to S315 and determines whether the dot formation number DN is equal to or more than the threshold THd. When determining that the dot formation number DN is equal to or more than the threshold THd (S315: Yes), the CPU 210 performs a process of S320 to S335 to evacuate the print head 110 and perform flushing.

When determining that the current holding state is the both-side holding state (S310: No) or that the dot formation number DN is less than the threshold THd (S315: No), the CPU 210 performs a process of S340 to S355 to perform flushing without evacuating the print head 110.

When determining that the flushing execution condition is not satisfied (S305: No), in the same manner as in S310 and S315, the CPU 210 determines in S360 and S365 whether to evacuate the print head 110 in the sheet conveyance operation TR after the target partial printing operation.

In S360, the CPU 210 determines whether the current holding state, that is, the holding state for holding the sheet M during the target partial printing operation is the single-side holding state (see FIG. 4B) or the both-side holding state (see FIG. 4A). When determining that the current holding state is the single-side holding state (S360: Yes), the CPU 210 goes to S365 and determines whether the dot formation number DN is equal to or more than the threshold THd. When determining that the dot formation number DN is equal to or more than the threshold THd (S365: Yes), the CPU 210 performs a process of S370 to S385 to evacuate the print head 110 without performing flushing.

When determining that the current holding state is the both-side holding state (S360: No) or that the dot formation number DN is less than the threshold THd (S365: No), the CPU 210 performs a process of S390 to S405 without evacuating the print head 110 or performing flushing.

Figure 11A:
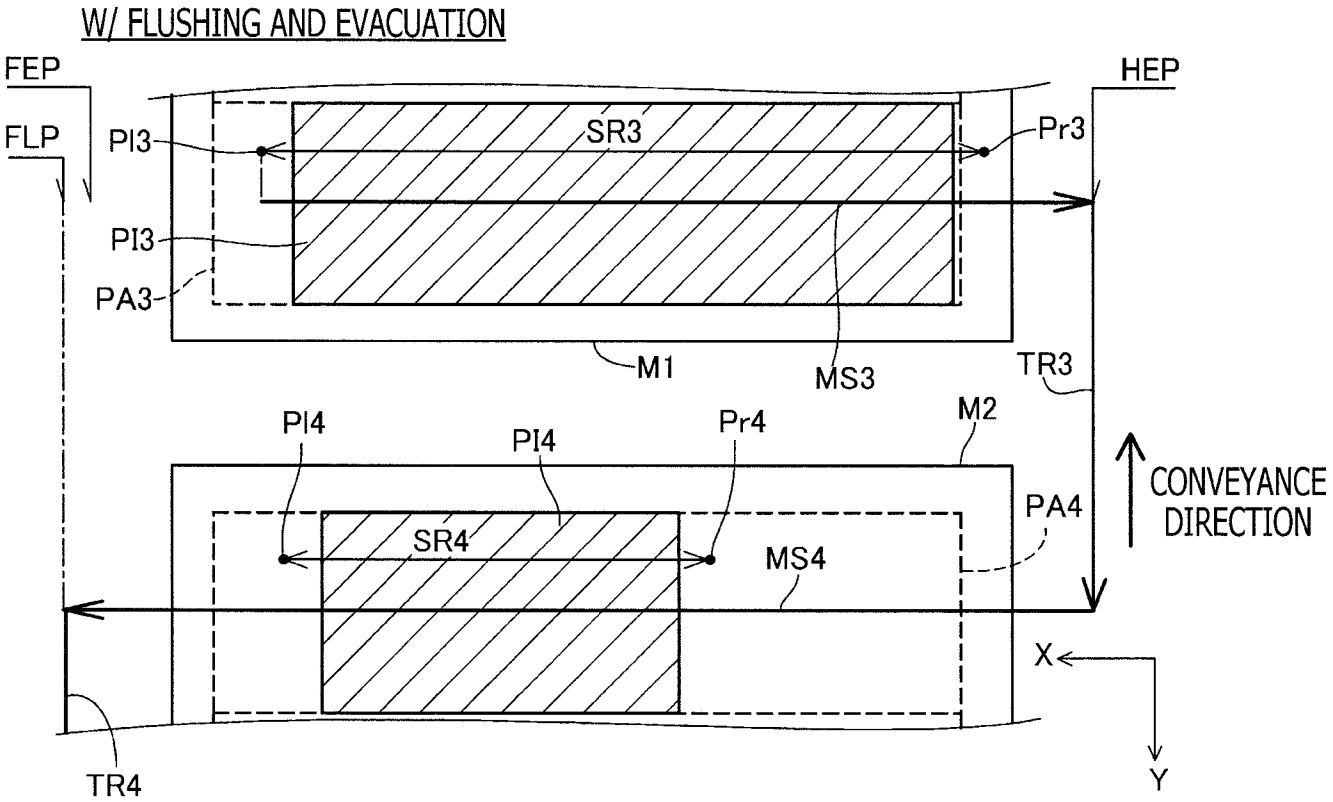
FIG. 11A illustrates a process of S320 to S335 in the between-sheet process in the illustrative embodiment according to one or more aspects of the present disclosure.
Figure 11B:
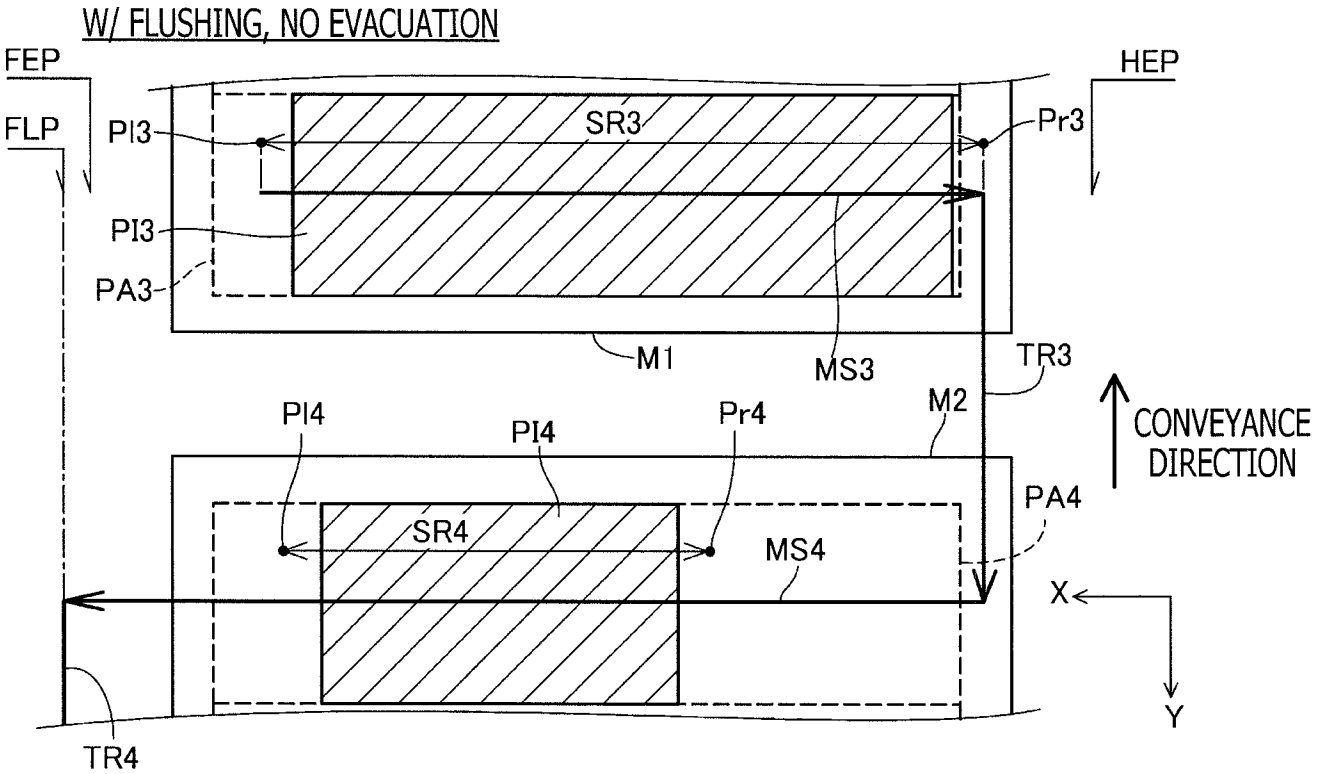
FIG. 11B illustrates a process of S340 to S355 in the between-sheet process in the illustrative embodiment according to one or more aspects of the present disclosure.

FIGS. 11A and 11B are a second set of illustrations for explaining the between-sheet process. FIG. 11A illustrates the process of S320 to S335 to evacuate the print head 110 and perform flushing. In S320, the CPU 210 determines the home-side evacuation position HEP (see FIG. 6B) as the stop position of the main scanning for the target partial printing operation. In S325, the CPU 210 causes the print mechanism 100 to perform the target partial printing operation, i.e., the final partial printing operation SP on the sheet M being printed. In the example shown in FIG. 11A, the print mechanism 100 performs the final partial printing operation SP3 on the first sheet M1 while performing the main scanning operation MS3 in the HP direction. As shown in FIG. 11A, the stop position of the main scanning operation MS3 is the home-side evacuation position HEP.

In S330, in the same manner as in S235 (see FIG. 9A), the CPU 210 causes the print mechanism 100 to perform sheet discharging and sheet feeding. Specifically, as indicated as the sheet conveyance operation TR3 in the example of FIG. 11A, the print mechanism 100 discharges the first sheet M1 on which printing has been completed, and feeds the second sheet M2. In S335, the CPU 210 causes the print mechanism 100 to perform the first partial printing operation SP on the next sheet M and flushing. In the example shown in FIG. 11A, the print mechanism 100 performs the main scanning operation MS4 in the FL direction from the home-side evacuation position HEP to the flushing stop position FLP. During the main scanning operation MS4, the print mechanism 100 performs the partial printing operation SP4 to print the partial image PI4 and flushing (see FIGS. 6D and 6C).

FIG. 11B illustrates the process of S340 to S355 to perform flushing without evacuating the print head 110. In S340, the CPU 210 determines the stop position of the main scanning, based on positions of downstream ends of the main scanning ranges SR for the target partial printing operation and the next partial printing operation in the HP direction (i.e., based on positions of upstream ends of the main scanning ranges SR for the target partial printing operation and the next partial printing operation in the X-axis direction). Specifically, the CPU 210 determines a more downstream one, in the HP direction, of the downstream end of the main scanning range SR for the target partial printing operation in the HP direction and the downstream end of the main scanning range SR for the next partial printing operation in the HP direction, as the stop position of the main scanning for the target partial printing operation. In the example shown in FIG. 11B, the upstream end Pr3 of the main scanning range SR3 for the target partial printing operation (i.e., the final partial printing operation SP3 on the first sheet M1) in the X-axis direction is positioned upstream, in the X-axis direction, of the upstream end Pr4 of the main scanning range SR4 for the first partial printing operation SP4 on the second sheet M2 in the X-axis direction. Therefore, the upstream end Pr3 of the main scanning range SR3 in the X-axis direction is determined as the stop position of the main scanning for the target partial printing operation. In S345, the CPU 210 causes the print mechanism 100 to perform the target partial printing operation, i.e., the final partial printing operation SP on the sheet M being printed. In the example shown in FIG. 11B, the print mechanism 100 performs the final partial printing operation SP3 on the first sheet M1 while performing the main scanning operation MS3 in the HP direction. As shown in FIG. 11B, the stop position of the main scanning operation MS3 is the upstream end Pr3 of the main scanning range SR3 in the X-axis direction.

In S350, in the same manner as in S235, the CPU 210 causes the print mechanism 100 to perform sheet discharging and sheet feeding. Specifically, as indicated as the sheet conveyance operation TR3 in the example of FIG. 11B, the print mechanism 100 discharges the first sheet M1 on which printing has been completed, and feeds the second sheet M2. In S355, the CPU 210 causes the print mechanism 100 to perform the first partial printing operation SP on the next sheet M and perform flushing. In the example shown in FIG. 11B, the print mechanism 100 performs the main scanning operation MS4 in the FL direction from the upstream end Pr3 of the main scanning range SR3 in the X-axis direction to the flushing stop position FLE. During the main scanning operation MS4, the print mechanism 100 performs the partial printing operation SP4 to print the partial image PI4 and performs flushing (see FIGS. 6D and 6C).

In the process of S340 to S355, the print mechanism 100 needs not move the print head 110 to the home-side evacuation position HEP during the main scanning operation MS3. Hence, it is possible to shorten the moving distance of the print head 110 in each of the main scanning operations MS3 and MS4. Therefore, it is possible to make the period of time for printing shorter than when performing the process of S320 to S335 to evacuate the print head 110 and perform flushing.

Figure 12A:
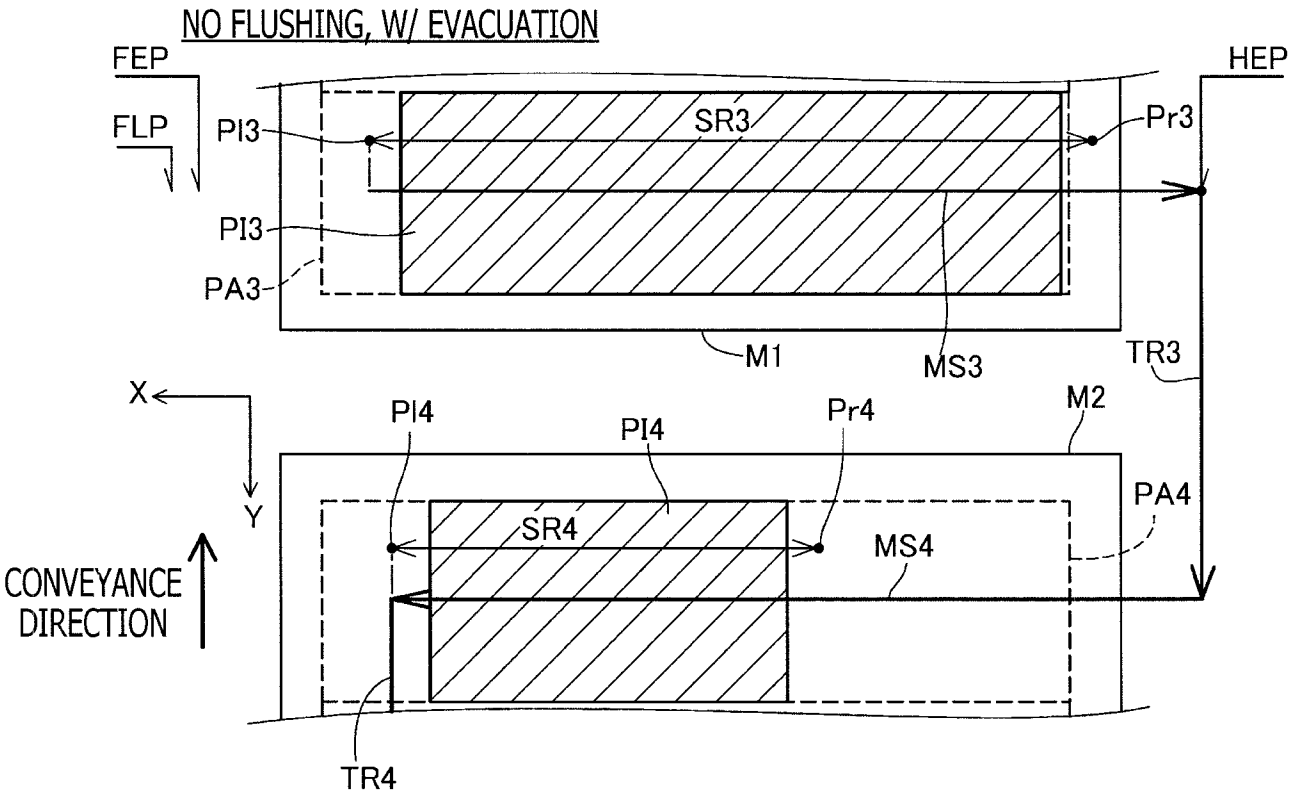
FIG. 12A illustrates a process of S370 to S385 in the between-sheet process in the illustrative embodiment according to one or more aspects of the present disclosure.
Figure 12B:
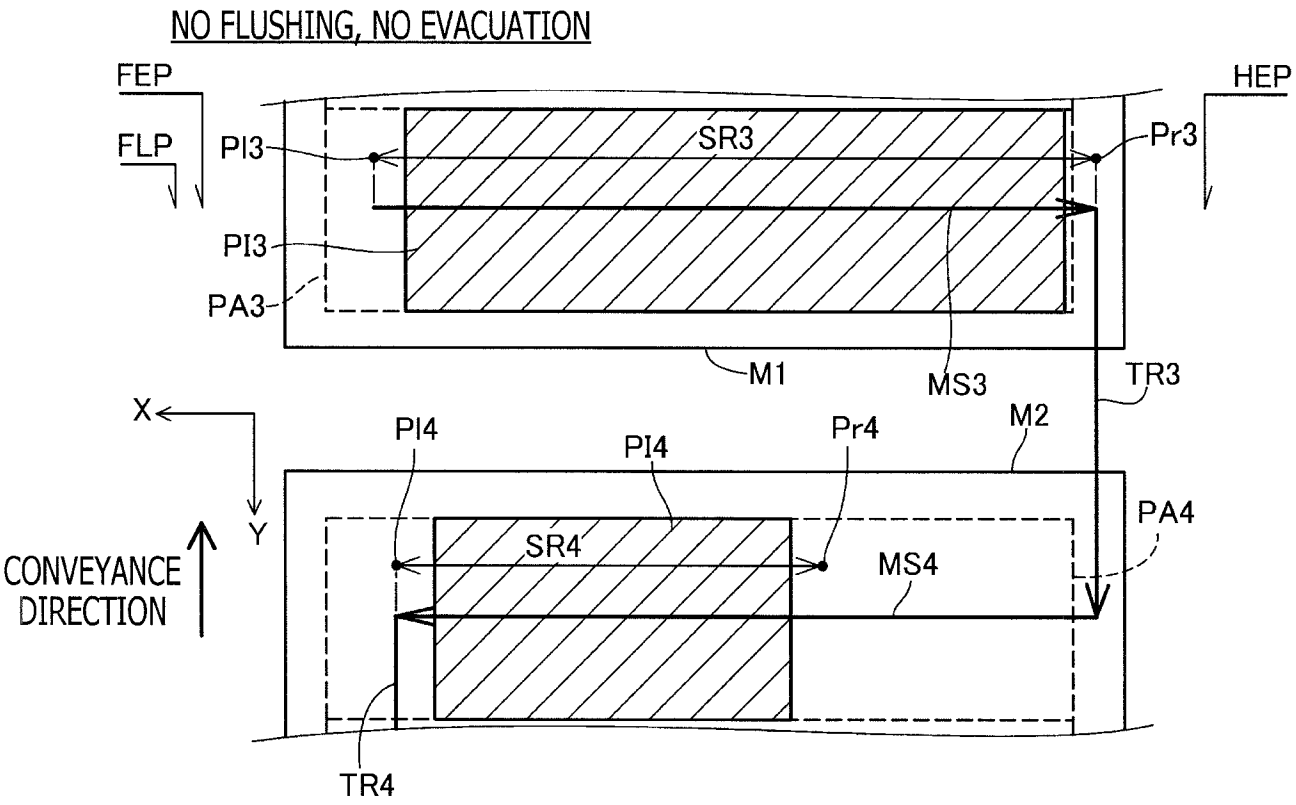
FIG. 12B illustrates a process of S390 to S405 in the between-sheet process in the illustrative embodiment according to one or more aspects of the present disclosure.

FIGS. 12A and 12B are a third set of illustrations for explaining the between-sheet process. FIG. 12A illustrates the process of S370 to S385 to evacuate the print head 110 without performing flushing. In S370, in the same manner as in S320, the CPU 210 determines the home-side evacuation position HEP (see FIG. 6B) as the stop position of the main scanning for the target partial printing operation. In S375, the CPU 210 causes the print mechanism 100 to perform the target partial printing operation, that is, the final partial printing operation SP on the sheet M being printed. In the example shown in FIG. 12A, the print mechanism 100 performs the final partial printing operation SP3 on the first sheet M1 while performing the main scanning operation MS3 in the HP direction. As shown in FIG. 12A, the stop position of the main scanning operation MS3 is the home-side evacuation position HEP.

In S380, in the same manner as in S235, the CPU 210 causes the print mechanism 100 to perform sheet discharging and sheet feeding. Specifically, as indicated as the sheet conveyance operation TR3 in the example of FIG. 12A, the print mechanism 100 discharges the first sheet M1 on which printing has been completed, and feeds the second sheet M2. In S385, the CPU 210 causes the print mechanism 100 to perform the first partial printing operation SP on the next sheet M. In the example shown in FIG. 12A, the CPU 210 causes the print mechanism 100 to perform the partial printing operation SP4 to print the partial image PI4 while performing the main scanning operation MS4 in the FL direction from the home-side evacuation position HEP to the downstream end Pl4 of the main scanning range SR4 in the X-axis direction.

FIG. 12B illustrates the process of S390 to S405 without evacuating the print head 110 or performing flushing. In S390, in the same manner as in S340, the CPU 210 determines the stop position of the main scanning for the target partial printing operation, based on the positions of the downstream ends of the main scanning ranges SR for the target partial printing operation and the next partial printing operation in the HP direction (i.e., based on the positions of the upstream ends of the main scanning ranges SR for the target partial printing operation and the next partial printing operation in the X-axis direction). In the example shown in FIG. 12B, the upstream end Pr3 of the main scanning range SR3 in the X-axis direction is determined as the stop position of the main scanning operation MS3. In S395, the CPU 210 causes the print mechanism 100 to perform the target partial printing operation, that is, the final partial printing operation SP on the sheet M being printed. In the example shown in FIG. 12B, the print mechanism 100 performs the final partial printing operation SP3 on the first sheet M1 while performing the main scanning operation MS3 in the HP direction. As shown in FIG. 12B, the stop position of the main scanning operation MS3 is the upstream end Pr3 of the main scanning range SR3 in the X-axis direction.

In S400, in the same manner as in S235, the CPU 210 causes the print mechanism 100 to perform sheet discharging and sheet feeding. Specifically, as indicated as the sheet conveyance operation TR3 in the example of FIG. 12B, the print mechanism 100 discharges the first sheet M1 on which printing has been completed, and feeds the second sheet M2. In S405, the CPU 210 causes the print mechanism 100 to perform the first partial printing operation SP on the next sheet M. In the example shown in FIG. 12B, the print mechanism 100 performs the partial printing operation SP4 to print the partial image PI4 while performing the main scanning operation MS4 in the FL direction from the upstream end Pr3 of the main scanning range SR3 in the X-axis direction to the downstream end Pl4 of the main scanning range SR4 in the X-axis direction.

After completion of the first partial printing operation SP on the next sheet M in each of the steps S240, S270, S290, S335, S355, S385, and S405 (see FIGS. 9A to 9D), the CPU 210 causes the print mechanism 100 to convey the sheet M only by the nozzle length D in S410 (see FIG. 9A). This sheet conveyance is represented, for instance, by the sheet conveyance operation TR4 in each of the examples shown in FIGS. 7, 11A, 11B, 12A, 12B, 13A, and 13B.

As described above, in the illustrative embodiment, the CPU 210 determines whether the specific conditions are satisfied. The specific conditions represent that when the specific conditions are satisfied, the sheet M being printed is more likely to be deformed than when at least one of the specific conditions is not satisfied (see S245 and S250 in FIG. 9B, S310 and S315 in FIG. 9C, and S360 and S365 in FIG. 9D). The CPU 210 causes the print mechanism 100 to perform the final partial printing operation SP3 on the first sheet M1, then discharge the first sheet M1 and feed the second sheet M2, and thereafter perform the first partial printing operation SP4 on the second sheet M2 (see FIGS. 7, 11A, 11B, 12A, 12B, 13A, and 13B). In a first case where at least one of the specific conditions is not satisfied with respect to the first sheet M1 (i.e., when a negative determination is made in one of the steps S245, S250, S310, S315, S360, and S365), the CPU 210 causes the print mechanism 100 to, after performing the partial printing operation SP3, start conveying the first sheet M1 without evacuating the print head 110 (i.e., with the plurality of nozzles NZ located within the sheet range PR included in the movable range MR) (see the sheet conveyance operation TR3 in FIGS. 7, 12B, and 13B). In a second case where the specific conditions are satisfied with respect to the first sheet M1 (i.e., when an affirmative determination is made in both of the steps S245 and S250, or in both of the steps S310 and S315, or in both of the steps S360 and S365), the CPU 210 causes the print mechanism 100 to, after performing the partial printing operation SP3, evacuate the print head 110 to one of the evacuation positions FEP and HEP (i.e., move the print head 110 to such a position that the plurality of nozzles NZ are located out of the sheet range PR, within the movable range MR), and thereafter start conveying the first sheet M1 (see FIGS. 10B, 11A, and 12A).

In the sheet conveyance operation TR3 after completion of the final partial printing operation SP3 on the first sheet M1, the first sheet M1 is conveyed with ink Ik attached thereon. Therefore, the first sheet M1 is likely to be deformed during the sheet conveyance operation TR3. If the nozzles NZ of the print head 110 are within the sheet range PR when the first sheet M1 is deformed, the deformed first sheet M1 might come into contact with the nozzles NZ of the print head 110. In the aforementioned illustrative embodiment, when the specific conditions are satisfied, the print head 110 is evacuated to such a position that the plurality of nozzles NZ are located out of the sheet range PR, and thereafter the first sheet M1 begins to be conveyed (i.e., the sheet conveyance operation TR3 is performed). Therefore, even when the first sheet M1 is more likely to be deformed, it is possible to prevent the first sheet M1 from contacting the nozzles NZ of the print head 110. Meanwhile, when at least one of the specific conditions is not satisfied, the first sheet M1 begins to be conveyed with the plurality of nozzles NZ positioned within the sheet range PR. Hence, the first sheet M1 is less likely to be deformed, it is possible to promptly start conveying the first sheet M1. Consequently, when the plurality of sheets M1 and M2 are sequentially printed, it is possible to prevent the first sheet M1 from contacting the nozzles NZ of the print head 110 and suppress a reduction in the printing speed.

Further, in the aforementioned illustrative embodiment, when at least one of the specific conditions is not satisfied with respect to the first sheet M1, for instance, in the example shown in FIG. 7, the CPU 210 determines the stop position of the main scanning operation MS3 (S275) in the following manner. The CPU 210 specifies the downstream end of the partial image PI3 in the FL direction (i.e., the downstream end of the partial printing operation SP3 in the printing direction), and the downstream end of the partial image PI4 in the FL direction. The CPU 210 determines a position (specifically, the downstream end PI3 of the main scanning range SR3 in the X-axis direction in FIG. 7) that is located downstream of the above specified two ends in the FL direction and within the sheet range PR, as the stop position of the main scanning operation MS3, in S275 in FIG. 9B (see FIG. 7). Then, after the partial printing operation SP3, the CPU 210 stops the print head 110 at the determined stop position in S280 in FIG. 9B (see FIG. 7). Afterward, the CPU 210 causes the print mechanism 100 to perform the main scanning operation MS4 to move the print head 110 in the HP direction, opposite to the printing direction for the partial printing operation SP3, from the stop position, as main scanning for the partial printing operation SP4, in S290 in FIG. 9B (see FIG. 7).

Likewise, in the example shown in FIGS. 11B and 12B, in S340 and S390, the CPU 210 determines, as the stop position of the print head 110, a position that is within the sheet range PR and downstream, in the HP direction, of a downstream end of the partial image PI3 in the HP direction (i.e., a downstream end of the partial image PI3 in the printing direction) and a downstream end of the partial image PI4 in the HP direction. Specifically, in S340 and S390, the CPU 210 determines, as the stop position of the print head 110, the upstream end Pr3 of the main scanning range SR3 in the X-axis direction (see FIGS. 11B and 12B).

Consequently, the stop position of the print head 110 is determined based on the downstream end of the partial image PI3 in the printing direction and the downstream end of the partial image PI4 in the printing direction. Therefore, when at least one of the specific conditions is not satisfied with respect to the first sheet M1, that is, when the first sheet M1 is unlikely to be deformed, it is possible to avoid useless movement of the print head 110 and achieve an increased printing speed. For instance, if the print head 110 is evacuated although the first sheet M1 is unlikely to be deformed, it would cause a reduction in the printing speed since the moving distances for the main scanning operations MS3 and MS4 are excessively long. In the aforementioned illustrative embodiment, it is possible to prevent such a reduction in the printing speed.

Further, in the aforementioned illustrative embodiment, as shown in FIGS. 6A and 6B, the flushing-side evacuation position and the home-side evacuation position HEP are positions to which the print head 110 is evacuated in such a manner that not only the plurality of nozzles NZ but also the print head 110 are entirely positioned out of the sheet range PR. Thus, as the print head 110 is evacuated, it is possible to prevent the first sheet M from contacting the nozzle-formed surface 111 of the print head 110.

Further, in the aforementioned illustrative embodiment, the CPU 210 calculates the dot formation number DN as an index value concerning the amount of ink to be used for the partial printing operation SP3 (S210 in FIG. 9A). Then, when the dot formation number DN is equal to or more than the threshold THd, the CPU 210 determines that the second specific condition is satisfied (S250, S315, S365: Yes). A portion close to the upstream end of the first sheet M1 in the conveyance direction AR is more likely to be deformed as the amount of ink Ik to be discharged onto the first sheet M1 in the partial printing operation SP3 increases. In the aforementioned illustrative embodiment, by using the dot formation number DN, it is possible to properly determine whether the second specific condition is satisfied.

Further, in the aforementioned illustrative embodiment, when the partial printing operation SP3 is performed in the single-side holding state (i.e., when an affirmative determination is made in one of the steps S245, S310, and S360), the CPU 210 determines that the first specific condition is satisfied. When the partial printing operation SP3 is performed in the single-side holding state, a margin of an upstream end portion of the first sheet M1 in the conveyance direction AR is relatively narrow. In this case, ink Ik is attached to a portion close to the upstream end of the first sheet M1 in the conveyance direction AR. When the partial printing operation SP3 is performed in the both-side holding state, it is possible to prevent the first sheet M1 from being deformed immediately after the partial printing operation SP3 within the main scanning range SR3. In addition, when the partial printing operation SP3 is performed in the both-side holding state, the margin of the upstream end portion of the first sheet M1 in the conveyance direction AR is relatively wide. In this case, ink Ik is not attached to the portion close to the upstream end of the first sheet M1 in the conveyance direction AR. Hence, when the partial printing operation SP3 is performed in the single-side holding state, the portion close to the upstream end of the first sheet M1 in the conveyance direction AR is more likely to be deformed than when the partial printing operation SP3 is performed in the both-side holding state. Thus, in the aforementioned illustrative embodiment, it is possible to properly determine whether the first specific condition is satisfied, in accordance with the holding state for holding the first sheet M1.

Further, in the aforementioned illustrative embodiment, when the printing direction for the partial printing operation SP3 is the FL direction, the print head 110 is evacuated to the flushing-side evacuation position FEP (see S255 in FIG. 9B, and FIG. 10B). When the printing direction for the partial printing operation SP3 is the HP direction, the print head 110 is evacuated to the home-side evacuation position HEP (see S320 and S370 in FIGS. 9C and 9D, and FIGS. 11A and 12A). Namely, in an attempt to evacuate the print head 110 after the partial printing operation SP3, the print head 110 is moved to an evacuation position downstream of the sheet range PR in the printing direction for the partial printing operation SP3, before the sheet conveyance operation TR3. After the sheet conveyance operation TR3, the next partial printing operation SP4 is performed in a printing direction opposite to the printing direction for the partial printing operation SP3. Consequently, even when the print head 110 is evacuated, it is possible to avoid useless movement of the print head 110. Suppose for instance that the flushing-side evacuation position FEP is only an available evacuation position, and the print head 110 needs to be moved to the flushing-side evacuation position FEP even when the printing direction for the partial printing operation SP3 is the HP direction. In this case, the print head 110 needs to be moved to the flushing-side evacuation position FEP by performing main scanning in the FL direction between the partial printing operations SP3 and SP4. Thus, useless movement of the print head 110 is needed between the partial printing operations SP3 and SP4. In contrast, in the aforementioned illustrative embodiment, there is no need for such useless movement of the print head 110 between the partial printing operations SP3 and SP4.

Further, in the aforementioned illustrative embodiment, the print mechanism 100 includes the ink receiver 170 (see FIGS. 6A, 6C, and 6D) disposed downstream of the sheet range PR in the FL direction. When the printing direction for the partial printing operation SP3 is the FL direction (S215: Yes), and the flushing execution condition is satisfied (S220: Yes), the CPU 210 causes the print mechanism 100 to perform flushing after the partial printing operation SP3 (see S240 in FIG. 9A, and FIG. 10A). When the printing direction for the partial printing operation SP3 is the HP direction (S215: No), and the flushing execution condition is satisfied (S305: Yes), the CPU 210 causes the print mechanism 100 to perform flushing after the partial printing operation SP4 (see S335 and S355 in FIG. 9C, and FIGS. 11A and 11B). Accordingly, it is possible to avoid useless movement of the print head 110 to perform flushing. Suppose for instance that when the printing direction for the partial printing operation SP3 is the HP direction, the CPU 210 causes the print mechanism 100 to perform flushing after the partial printing operation SP3. In this case, after the partial printing operation SP3, the print head 110 needs to be moved in the FL direction only for flushing. Thus, useless movement of the print head 110 is needed only for flushing. In contrast, in the aforementioned illustrative embodiment, there is no need for such useless movement of the print head 110 only for flushing.

Hereinabove, the illustrative embodiment according to aspects of the present disclosure has been described. Aspects of the present disclosure may be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications according to aspects of the present disclosure are feasible.

B. Modifications

In the aforementioned illustrative embodiment, it is determined whether the specific conditions for determining whether to evacuate the print head 110 are satisfied, based on the holding state for folding the sheet M and the dot formation number DN. Instead, other specific conditions may be applied. Each of FIGS. 13A and 13B shows another example of the first specific condition in a modification according to aspects of the present disclosure.

Figure 13A:
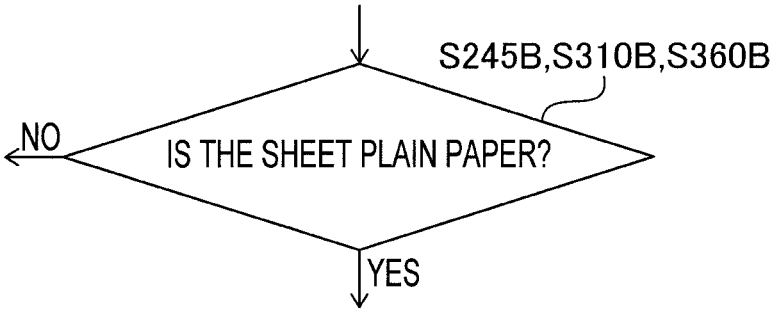
FIG. 13A shows an example of a specific condition in a modification according to one or more aspects of the present disclosure.

As shown in FIG. 13A, S245B, S310B, and S360B may be performed instead of S245, S310, and S360, respectively. In S245B, S310B, and S360B, the CPU 210 may specify a type of the sheet M being printed and may determine whether the sheet M being printed is plain paper. For instance, the type of the sheet M may be specified based on sheet information previously input by the user. A print medium such as the sheet M has a different degree of deformability depending on the type of the print medium. For instance, plain paper, which is thinner than glossy paper and high-quality paper, is more easily deformed by ink Ik soaking thereinto than the glossy paper and the high-quality paper. Therefore, in this modification, when the sheet M being printed is plain paper (S245B, S310B, S360B: Yes), the CPU 210 may determine that a first specific condition is satisfied. Meanwhile, when the sheet M being printed is a different type of paper (glossy paper or high-quality paper) from plain paper (S245B, S310B, S360B: No), the CPU 210 may determine that the first specific condition is not satisfied. Thus, in the modification, it is possible to properly determine whether the first specific condition is satisfied, based on the type of the sheet M.

Figure 13B:
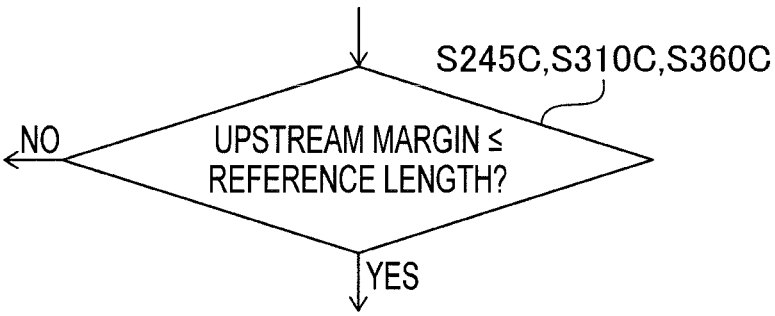
FIG. 13B shows an example of the specific condition in another modification according to one or more aspects of the present disclosure.

As shown in FIG. 13B, S245C, S310C, and S360C may be performed instead of S245, S310, and S360, respectively. In S245C, S310C, and S360C, the CPU 210 may determine whether the upstream margin of the sheet M being printed in the conveyance direction AR is equal to or narrower than a reference length. In other words, in S245C, S310C, and S360C, it may be determined whether a length between an upstream end of an image to be printed on the sheet M being printed in the conveyance direction AR and the upstream end of the sheet M in the conveyance direction AR is equal to or narrower than the reference length. When the upstream margin of the sheet M being printed in the conveyance direction AR is equal to or narrower than the reference length, ink Ik is attached to a portion close to the upstream end of the sheet M in the conveyance direction AR. Therefore, an upstream end portion of the sheet M in the conveyance direction AR is more likely to be deformed and come into contact with the print head 110. Meanwhile, when the upstream margin of the sheet M being printed in the conveyance direction AR is wider than the reference length, ink Ik is not attached to the portion close to the upstream end of the sheet M in the conveyance direction AR. Therefore, the upstream end portion of the sheet M in the conveyance direction AR is less likely to be deformed. Hence, in this modification, when the upstream margin of the sheet M being printed in the conveyance direction AR is equal to or narrower than the reference length (S245C, S310C, S360C: Yes), the CPU 210 may determine that a first specific condition is satisfied. Meanwhile, when the upstream margin of the sheet M being printed in the conveyance direction AR is wider than the reference length (S245C, S310C, S360C: No), the CPU 210 may determine that the first specific condition is not satisfied.

Among the specific conditions (e.g., the conditions regarding the holding state for holding the sheet M, the dot formation number DN, the type of the sheet M, and the upstream margin of the sheet M in the conveyance direction AR) as exemplified in the aforementioned illustrative embodiment and modifications, one or more specific conditions may be applied to determine whether to evacuate the print head 110. Preferably, the applied one or more specific conditions may represent that when the one or more specific conditions are satisfied, a print medium (e.g., a sheet M) being printed is more likely to be deformed than when at least one of the one or more specific conditions is not satisfied.

In the aforementioned illustrative embodiment, when at least one of the specific conditions is not satisfied, the stop position of the partial printing operation SP3 is determined based on the position of the downstream end of the main scanning range SR3 in the printing direction for the partial printing operation SP3 and the position of the downstream end of the main scanning range SR4 in the printing direction for the partial printing operation SP3 (S275, S340, and S390). Namely, the stop position of the partial printing operation SP3 is variable depending on the positions of the downstream ends of the partial images PI3 and PI4 in the printing direction for the partial printing operation SP3. Instead, for instance, the stop position of the partial printing operation SP3 may be determined to be a fixed position of a downstream end of the printable area IA1 in the printing direction for the partial printing operation SP3, regardless of the positions of the downstream ends of the partial images PI3 and PI4 in the printing direction for the partial printing operation SP3.

In the aforementioned illustrative embodiment, as shown in FIGS. 6A and 6B, in each of the evacuation positions FEP and HEP, the print head 110 is entirely outside the sheet range PR in the X-axis direction. Instead, for instance, in each of the evacuation positions FEP and HEP, the print head 110 may be placed in such a state that, in the X-axis direction, the nozzle rows NK, NY, NC, and NM are outside the sheet range PR while a corresponding end portion of the print head 110 that is closer to the sheet range PR than the nozzle rows NK, NY, NC, and NM are within the sheet range PR. Even in this case, it is possible to at least prevent the deformed sheet M from contacting the nozzle rows NK, NY, NC, and NM.

Further, the flushing-side evacuation position FEP and the flushing stop position FLP may be the same position.

In the aforementioned illustrative embodiment, when the printing direction of the final partial printing operation SP3 on the first sheet M1 is the HP direction, and flushing is performed, the flushing is performed after the partial printing operation SP4 (see S335, S355, and FIGS. 11A and 11B). Instead, when the printing direction of the final partial printing operation SP3 on the first sheet M1 is the HP direction, and flushing is performed, the flushing may be performed before the partial printing operation SP3. In this case, the stop position of main scanning for the partial printing operation SP2 may be set to the flushing stop position FLP, and the print head 110 may be moved to the flushing stop position FLP prior to the partial printing operation SP3.

In the aforementioned illustrative embodiment, there is a case where flushing is performed between the final partial printing operation SP3 on the first sheet M1 and the first partial printing operation SP4 on the second sheet M2. Instead, for instance, the CPU 210 may cause the print mechanism 100 to perform flushing only before starting printing in response to receipt of a print instruction and never perform flushing between the final partial printing operation SP3 on the first sheet M1 and the first partial printing operation SP4 on the second sheet M2. In this case, the steps of S220 to S240 (see FIG. 9A) and S305 to S355 (see FIG. 9C) may be omitted. In this case, whenever the target printing direction is the FL direction (S215: Yes), the CPU 210 may go to S245. Meanwhile, whenever the target printing direction is the HP direction (S215: No), the CPU 210 may go to S360.

Instead of the dot formation number DN, another index value concerning the amount of ink to be used for the target partial printing operation may be applied. For instance, when the CPU 210 is allowed to obtain CMYK image data of a partial image to be printed in the target partial printing operation, the said another index value may be an integrated value of individual color components of the CMYK image data. In another instance, the said another index value may be a ratio of the number of pixels in which dots are actually formed to print the partial image to the total number of all pixels included in the partial image.

The configuration of the ink receiver 170 as described in the aforementioned illustrative embodiment is merely an example. For instance, the ink receiver 170 may be an ink absorbing member (e.g., a sponge) located below the whole of the nozzle rows NK, NY, NC, and NM when the print head 110 is in the flushing stop position FLP. In this case, the CPU 210 may cause the print mechanism 100 to perform flushing with the print head 110 stopped in the flushing stop position FLP, without performing main scanning.

The configuration of the conveyor 140 as described in the aforementioned illustrative embodiment is merely an example. In the illustrative embodiment, the conveyor 140 is configured to hold the sheet to be deformed in a wave shape and convey the sheet M. Instead, the conveyor 140 may be configured to convey the sheet M while holding the sheet to be flat without deforming the sheet M in a wave shape. Specifically, the conveyor 140 may not include the supporting members 142 or 143, or the pressing members 146.

In the aforementioned illustrative embodiment, bidirectional printing along the X-axis direction is applied. Nonetheless, for instance, unidirectional printing to perform partial printing operations only in the FL direction or only in the HP direction may be applied. Even in this case, preferably, when at least one of the specific conditions is not satisfied, the CPU 210 may cause the print mechanism 100 to stop the print head 110 within the sheet range PR without moving the print head 110 to a corresponding evacuation position after the final partial printing operation SP3 on the first sheet Ml. Further, preferably, when the specific conditions are satisfied, the CPU 210 may cause the print mechanism 100 to move the print head 110 to the corresponding evacuation position after the final partial printing operation SP3 on the first sheet Ml. Even in this case, when at least one of the specific conditions is not satisfied, it is possible to achieve a shortened moving distance in each main scanning for the final partial printing operation SP3 on the first sheet M1 and the first partial printing operation SP4 on the second sheet M2. Further, when the specific conditions are satisfied, it is possible to prevent the first sheet M1 from contacting the nozzles NZ of the print head 110. Thus, even in this case, it is possible to prevent a print medium from contacting the nozzles NZ of the print head 110 and suppress a reduction in the printing speed.

Examples of the sheets M applicable as print media may include, but are not limited to, deformable media such as transparencies and various types of paper.

In the aforementioned illustrative embodiment, the CPU 210 of the printer 200 performs the printing process shown in FIG. 8. Instead, another apparatus or device (e.g., the terminal device 300) may perform the printing process shown in FIG. 8. In this case, for instance, the terminal device 300 may serve as a printer driver when the CPU 310 of the terminal device 300 executes a driver program included in the computer programs 320*a* stored in the non-volatile memory 320 (see FIG. 1), thereby controlling the printer 200 to perform printing, as a part of the function as the printer driver. In this case, the terminal device 300 may control the printer 200, for instance, by transmitting commands along with partial print data to the printer 200 via the communication I/F 330. The commands may include a main scanning command indicating a stop position of the print head 110, a conveyance command indicating a conveyance distance for conveying the sheet M, and a command instructing the printer 200 to perform flushing.

As described above, in the aforementioned illustrative embodiment, the CPU 210 may be an example of a "control device" according to aspects of the present disclosure. In this case, the non-volatile memory 220 storing the computer program 220*a* may be included in the "control device" according to aspects of the present disclosure. Further, the print mechanism 100 may be an example of a "print execution device" according to aspects of the present disclosure. Meanwhile, in the above modification in which the terminal device 300 performs the printing process shown in FIG. 8, the terminal device 300 may be an example of the "control device" according to aspects of the present disclosure. Further, the whole of the printer 200 may be an example of the "print execution device" according to aspects of the present disclosure.

For instance, the print execution device configured to perform the printing process (see FIG. 8) may be a server configured to obtain image data from the printer 200 or the terminal device 300, generate commands (e.g., the conveyance command) and the print data based on the obtained image data, and transmit the generated commands and the generated print data to the printer 200. The server may include a plurality of computers communicably interconnected via a network.

Some of the configurations realized by the hardware in the aforementioned illustrative embodiment may be replaced with software. Conversely, some or all of the configurations realized by the software may be replaced with hardware. For instance, some of the steps or the operations included in the printing process (see FIG. 8) may be implemented by one or more specific hardware circuits (e.g., ASICs) configured to operate in accordance with instructions from the CPU 210.

The following shows examples of associations between elements exemplified in the aforementioned illustrative embodiment and modifications and elements according to aspects of the present disclosure. A "control device" according to aspects of the present disclosure may include the CPU 210 and the non-volatile memory 220 storing the computer program 220*a*. Namely, the CPU 210 may be an example of a "processor" according to aspects of the present disclosure, and the non-volatile memory 220 may be an example of a "memory" according to aspects of the present disclosure. In this case, the print mechanism 100 may be an example of a "print execution device" according to aspects of the present disclosure. Further, the non-volatile memory 220 may be an example of a "non-transitory computer-readable medium" according to aspects of the present disclosure. In another instance, the terminal device 300 may be an example of the "control device" according to aspects of the present disclosure. Namely, the CPU 310 may be an example of the "processor" according to aspects of the present disclosure, and the non-volatile memory 320 may be an example of the "memory" according to aspects of the present disclosure. In this case, the printer 200 may be an example of the "print execution device" according to aspects of the present disclosure. Further, the non-volatile memory 320 may be an example of the "non-transitory computer-readable medium" according to aspects of the present disclosure. The partial printing operation SP3 may be an example of a "final partial printing operation on a first sheet" according to aspects of the present disclosure. The partial printing operation SP4 may be an example of an "initial partial printing operation on a second sheet" according to aspects of the present disclosure. The movable range MR may be an example of a "movable range" according to aspects of the present disclosure. The sheet range PR may be an example of a "sheet range" according to aspects of the present disclosure. An "upstream holder" according to aspects of the present disclosure may include the upstream rollers 147, the low supporting members 143, and the pressing members 146. The downstream rollers 148 may be an example of a "downstream holder" according to aspects of the present disclosure.

What is claimed is:

1. A control device comprising:

a processor configured to control a print execution device comprising:

a print head having a plurality of nozzles configured to discharge ink onto a sheet;

a main scanning mechanism configured to perform a main scanning operation to move the print head along a main scanning direction relative to the sheet; and a conveyor configured to convey the sheet in a conveyance direction intersecting the main scanning direction relative to the print head, the print execution device being configured to perform printing by repeatedly performing a partial printing operation to cause the print head to form dots on the sheet during the main scanning operation and a conveyance operation to cause the conveyor to convey the sheet in the conveyance direction; and a memory storing computer-readable instructions configured to, when executed by the processor, cause the processor to:

obtain image data;

based on the obtained image data, control the print execution device to perform printing on a plurality of sheets including a first sheet and a second sheet, the printing including:

a final partial printing operation on the first sheet;

a final conveyance operation to convey the first sheet after the final partial printing operation on the first sheet;

an initial conveyance operation to convey the second sheet to be printed after the first sheet; and an initial partial printing operation on the second sheet after the initial conveyance operation to convey the second sheet;

determine whether one or more specific conditions are satisfied with respect to the first sheet being printed, the one or more specific conditions representing that when the one or more specific conditions are satisfied, the first sheet is more likely to be deformed than when at least one of the one or more specific conditions is not satisfied;

in a first case where at least one of the one or more specific conditions is not satisfied, after the final partial printing operation on the first sheet, control the print execution device to start the final conveyance operation to convey the first sheet in a state where the plurality of nozzles are located within a sheet range in which the first sheet is placed in the main scanning direction, within a movable range in which the print head is movable in the main scanning direction; and in a second case where the one or more specific conditions are satisfied, after the final partial printing operation on the first sheet, control the print execution device to move the print head to such a position that the plurality of nozzles are located out of the sheet range in the main scanning direction, within the movable range in the main scanning direction, before starting the final conveyance operation to convey the first sheet.

2. The control device according to claim 1, wherein the computer-readable instructions are further configured to, when executed by the processor, cause the processor to, in the first case, perform:

specifying a first end of a first partial image to be printed in the final partial printing operation on the first sheet, the first end being a downstream end of the first partial image in a first printing direction for the final partial printing operation on the first sheet;

specifying a second end of a second partial image to be printed in the initial partial printing operation on the second sheet, the second end being a downstream end of the second partial image in the first printing direction;

determining, as a stop position of the print head, a position that is located downstream of the specified first end and the specified second end in the first printing direction, within the sheet range; and controlling the print execution device to:

stop the print head at the determined stop position after the final partial printing operation on the first sheet; and perform the initial partial printing operation on the second sheet while performing the main scanning operation to move the print head from the stop position in a second printing direction opposite to the first printing direction.

3. The control device according to claim 1, wherein the computer-readable instructions are further configured to, when executed by the processor, cause the processor to, in the second case, control the print execution device to:

after the final partial printing operation on the first sheet, move the print head to a position where the print head is entirely located out of the sheet range in the main scanning direction, before starting the final conveyance operation to convey the first sheet in the conveyance direction.

4. The control device according to claim 1, wherein the computer-readable instructions are further configured to, when executed by the processor, cause the processor to:

calculate an index value concerning an amount of ink to be used for the final partial printing operation on the first sheet; and determine that the one or more specific conditions are satisfied, when the calculated index value represents that the amount of ink to be used for the final partial printing operation on the first sheet is equal to or more than a reference value.

5. The control device according to claim 1, wherein the conveyor comprises:

a downstream holder configured to hold the sheet in a position downstream of the plurality of nozzles in the conveyance direction position; and an upstream holder configured to hold the sheet in a position upstream of the plurality of nozzles in the conveyance direction position, and wherein the computer-readable instructions are further configured to, when executed by the processor, cause the processor to:

determine that the one or more specific conditions are satisfied, when the final partial printing operation on the first sheet is performed in a state where the first sheet is held by the downstream holder but not by the upstream holder.

6. The control device according to claim 1, wherein the computer-readable instructions are further configured to, when executed by the processor, cause the processor to, in the second case, control the print execution device to:

perform the final partial printing operation on the first sheet while performing the main scanning operation to move the print head in a first printing direction along the main scanning direction;

after moving the print head to a position where the plurality of nozzles are located downstream of the sheet range in the first printing direction, start the final conveyance operation to convey the first sheet in the conveyance direction; and after the initial conveyance operation to convey the second sheet, perform the initial partial printing operation on the second sheet while performing the main scanning operation to move the print head in a second printing direction opposite to the first printing direction.

7. The control device according to claim 1, wherein the print execution device further comprises an ink receiver disposed downstream of the sheet range in a particular direction along the main scanning direction, and wherein the computer-readable instructions stored in the memory are configured to, when executed by the processor, cause the processor to:

when the flushing execution condition is satisfied, and the particular direction is a printing direction for the final partial printing operation on the first sheet, control the print execution device to perform flushing to discharge ink toward the ink receiver, after the final partial printing operation on the first sheet; and when the flushing execution condition is satisfied, and the particular direction is opposite to the printing direction for the final partial printing operation on the first sheet, control the print execution device to perform flushing to discharge ink toward the ink receiver, after the initial partial printing operation on the second sheet, or before the final partial printing operation on the first sheet.

8. The control device according to claim 1, wherein the computer-readable instructions are further configured to, when executed by the processor, cause the processor to:

specify a type of the first sheet; and when the specified type of the first sheet is a particular type, determine that the one or more specific conditions are satisfied.

9. A non-transitory computer-readable medium storing computer-readable instructions executable by a processor configured to control a print execution device comprising:

a print head having a plurality of nozzles configured to discharge ink onto a sheet;

a main scanning mechanism configured to perform a main scanning operation to move the print head along a main scanning direction relative to the sheet; and a conveyor configured to convey the sheet in a conveyance direction intersecting the main scanning direction relative to the print head, the print execution device being configured to perform printing by repeatedly performing a partial printing operation to cause the print head to form dots on the sheet during the main scanning operation and a conveyance operation to cause the conveyor to convey the sheet in the conveyance direction, the computer-readable instructions being configured to, when executed by the processor, cause the processor to:

obtain image data;

based on the obtained image data, control the print execution device to perform printing on a plurality of sheets including a first sheet and a second sheet, the printing including:

a final partial printing operation on the first sheet;

a final conveyance operation to convey the first sheet after the final partial printing operation on the first sheet;

an initial conveyance operation to convey the second sheet to be printed after the first sheet; and an initial partial printing operation on the second sheet after the initial conveyance operation to convey the second sheet;

determine whether one or more specific conditions are satisfied with respect to the first sheet being printed, the one or more specific conditions representing that when the one or more specific conditions are satisfied, the first sheet is more likely to be deformed than when at least one of the one or more specific conditions is not satisfied;

in a first case where at least one of the one or more specific conditions is not satisfied, after the final partial printing operation on the first sheet, control the print execution device to start the final conveyance operation to convey the first sheet in a state where the plurality of nozzles are located within a sheet range in which the first sheet is placed in the main scanning direction, within a movable range in which the print head is movable in the main scanning direction; and in a second case where the one or more specific conditions are satisfied, after the final partial printing operation on the first sheet, control the print execution device to move the print head to such a position that the plurality of nozzles are located out of the sheet range in the main scanning direction, within the movable range in the main scanning direction, before starting the final conveyance operation to convey the first sheet.

10. A method implementable on a processor configured to control a print execution device comprising:

a print head having a plurality of nozzles configured to discharge ink onto a sheet;

a main scanning mechanism configured to perform a main scanning operation to move the print head along a main scanning direction relative to the sheet; and a conveyor configured to convey the sheet in a conveyance direction intersecting the main scanning direction relative to the print head, the print execution device being configured to perform printing by repeatedly performing a partial printing operation to cause the print head to form dots on the sheet during the main scanning operation and a conveyance operation to cause the conveyor to convey the sheet in the conveyance direction, the method comprising:

obtaining image data;

based on the obtained image data, controlling the print execution device to perform printing on a plurality of sheets including a first sheet and a second sheet, the printing including:

a final partial printing operation on the first sheet;

a final conveyance operation to convey the first sheet after the final partial printing operation on the first sheet;

an initial conveyance operation to convey the second sheet to be printed after the first sheet; and an initial partial printing operation on the second sheet after the initial conveyance operation to convey the second sheet;

determining whether one or more specific conditions are satisfied with respect to the first sheet being printed, the one or more specific conditions representing that when the one or more specific conditions are satisfied, the first sheet is more likely to be deformed than when at least one of the one or more specific conditions is not satisfied;

in a first case where at least one of the one or more specific conditions is not satisfied, after the final partial printing operation on the first sheet, controlling the print execution device to start the final conveyance operation to convey the first sheet in a state where the plurality of nozzles are located within a sheet range in which the first sheet is placed in the main scanning direction, within a movable range in which the print head is movable in the main scanning direction; and in a second case where the one or more specific conditions are satisfied, after the final partial printing operation on the first sheet, controlling the print execution device to move the print head to such a position that the plurality of nozzles are located out of the sheet range in the main scanning direction, within the movable range in the main scanning direction, before starting the final conveyance operation to convey the first sheet.

* * * * *